US007019225B2

(12) United States Patent
Matsumoto et al.

(10) Patent No.: US 7,019,225 B2
(45) Date of Patent: Mar. 28, 2006

(54) DEPRESSION RESPONSIVE SWITCH UNIT

(75) Inventors: Tadanao Matsumoto, Nishitokyo (JP); Naoki Iwao, Hino (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 36 days.

(21) Appl. No.: 10/819,568

(22) Filed: Apr. 6, 2004

(65) Prior Publication Data

US 2004/0200699 A1 Oct. 14, 2004

(30) Foreign Application Priority Data

Apr. 11, 2003 (JP) ..... 2003-108210
Mar. 29, 2004 (JP) ..... 2004-095640

(51) Int. Cl.
*H01H 9/00* (2006.01)

(52) U.S. Cl. ..... 200/5 R; 200/520; 200/341; 200/16 R

(58) Field of Classification Search ..... 200/5 R, 200/5 A, 16 R, 511–517, 520, 341
See application file for complete search history.

(56) References Cited

U.S. PATENT DOCUMENTS 5,121,091 A 6/1992 Fujiyama
5,508,479 A * 4/1996 Schooley ..... 200/5 R
5,607,049 A * 3/1997 Shioda ..... 200/557
5,621,196 A * 4/1997 Nishijima et al. ..... 200/6 A
5,744,765 A * 4/1998 Yamamoto ..... 200/6 A
6,246,019 B1 * 6/2001 Nakamura et al. ..... 200/6 A
2001/0013463 A1 8/2001 Asai et al.
2002/0056611 A1 5/2002 Oba et al.

FOREIGN PATENT DOCUMENTS

FR 1 316 747 A 2/1963
JP 08315682 11/1996
JP 10069835 3/1998
JP 3306311 7/2002

* cited by examiner

*Primary Examiner*—Kyung Lee
(74) *Attorney, Agent, or Firm*—David N. Lathrop, Esq; Gallagher & Lathrop

(57) ABSTRACT

A pusher formed of a rubber material, a click plate, a membrane switch which serves as a second step switch, a reinforcing plate, a membrane sheet on which a plurality of first step switches are formed, a key operation base and a knob are sequentially assembled into a case. The knob includes a plurality of depressing pieces having on its internal surface a projection which moves into contact with each membrane switch and also includes a marginal portion which is supported by the top surface of the case. The knob is thin-walled except for the depressing piece, and the thin-walled portion comprises a thermoplastic elastomer or silicone rubber. The knob, the key operation base and the reinforcing plate are secured together. As the depressing piece is depressed, the thin-walled portion which is located therearound becomes flexed, whereby the membrane switch is depressed by the projection to turn the switch on. When the depressing piece is further depressed, the reinforcing plate moves and the click plate reverses, turning the switch on.

23 Claims, 32 Drawing Sheets

DEPRESSION RESPONSIVE SWITCH UNIT

BACKGROUND OF THE INVENTION

The present invention relates to a depression responsive switch unit which is turned on in response to the depression of a knob.

A conventional depression responsive two-step switch unit which is disclosed in Japanese Laid-Open Patent Application No. 315,682/96 (laid open Nov. 29, 1996) will be briefly described with reference to FIGS. 1, 2, 3A and 3B. A rectangular case 2 includes a surface plate 2*a*, in which a rectangular opening 2-1 is formed, and a key top 3 is disposed to substantially block the opening 2-1. The key top 3 includes an elongate frame-shaped sidewall 3*g*, on the inner surface of which a reinforcing plate 3*c* is fitted and is secured in position by claws 3*d*. A membrane sheet 6 is held in overlapping relationship with the front side of the reinforcing plate 3*c*, and a surface sheet 3*e* is disposed on the front side of the membrane sheet 6 and is adhesively bonded to the end face of the sidewall 3*g* of the key top 3.

A plurality of depression regions 3*p* are defined in an array on the surface sheet 3*e*, and are designated by key identification characters, which are numbers "1", "2", . . . , "8" in the example shown. Regions on the membrane sheet 6 which are located opposite to the depression regions 3*p* are each designated as a membrane switch 6*s*. Specifically, a pair of flexible films 6*a* and 6*b*, as may be formed by polyethylene films, are stacked together with a spacer 6*c* therebetween to define a switch assembly for each depression region 3*p*. In each switch assembly, fixed contacts 6*d* and 6*e* are formed on the film 6*a* while a movable contact 6*f* is formed on the film 6*b* so as to be located opposite to the contacts 6*d* and 6*e*, thus completing the membrane switch 6*s*.

Rotary shafts 3*f* project externally from the opposite ends of the sidewall 3*g* of the key top 3 and are rotatably engaged with bearings 2*f* which are formed in the internal surface of the surface plate 2*a* of the case.

When the depression region 3*p* on the surface of the key top 3 is selectively depressed, the membrane switch 6*s* which is located opposite thereto has its movable contact 6*f* moved into contact with the both fixed contacts 6*d* and 6*e*, thus turning the switch on. As the key top 3 is further depressed, it moves angularly as shown in FIG. 3B and a pusher 3*a* extending form one side of the sidewall 3*g* of the key top 3 presses against a tact switch 7 which is mounted on the internal surface of a rear plate 2*b* of the case 2, thus turning it on.

When the key top 3 is released from the depression, a reaction which results from a resilient material within the tact switch 7 turns it off, and the restoring force of the flexible film 6*b* causes the movable contact 6*f* to move away from the fixed contacts 6*d* and 6*e* to turn the membrane switch 6*s* off. A flexible band-shaped cable 8 on which external connection lead wires for the contacts of the membrane switches 6*s* are formed by a printed circuit is taken out from the reinforcing plate 3*c*.

A two-step switch which is constructed in the manner mentioned above finds its use in an application where a temporary input is selectively made initially and a true input is made after confirmation of the temporary input. However, if an on-load is relatively high when an input is to be made to the first step switch, there is a likelihood that the second step switch may be turned on inadvertently. In a portable telephone or a vehicle onboard electrical instrument, a menu is displayed on a display screen, one of items in the menu is selected by a corresponding key, and on the basis of this selection, the display screen displays what item has been selected, and a user confirms this display, and if the display is proper, the user performs a key entry in order for that item to be truly selected. In this manner, it is possible for a user to try an entry by gently depressing a suitable key (depression region 3*p*) without recognizing a key operation surface, which may be the display of switch identifications on the surface sheet 3*e* in the example of FIG. 1, to know that one color among the menu items which corresponds to the display of the switch identification for the depressed key (depression region 3*p*) has changed to red or that that item has been selected without requiring the visual recognition of the display of the switch identifications. If the selected item is different from an item which the user desires to select, the user may then depress another depression region 3*p* gently. On the contrary, if the selected item were the item which the user intended to select, an entry for that item can be accomplished by further depressing the key. In other words, a selection from the menu can properly be accomplished without viewing the key operation surface, but while viewing only the display screen. By way of example, an operation of an onboard air conditioner, a control over CD player or DVD player, a selection of a radio channel to be received, a display of TV channel to be received or a display of an automatic road guide can be made while driving an automobile.

As mentioned above, the use of a two-step switch unit is greatly convenient in making a selection or exercising a control without a visual recognition of a key display surface or while performing a different task such as driving an automobile. In this instance, it would be understood that in order to provide a distinction between the first and the second step of the two-step entry and in consideration of the fact that there is a continued need to watch a particular direction such as looking forward when driving an automobile, it is preferred that a pressure that is required to make a temporary entry through the first step switch be small in magnitude. It is desirable that the first step switch can be operated with a pressure which is as weak as "tangibly feeling" the key display surface with a fingertip or "slipping" the fingertip along the key display surface.

However, in the conventional two-step switch unit cited above, there is a need to cause an elastic deformation of the surface sheet 3*e* and the flexible film 6*b* in order to turn on the first step switch or the membrane switch 6*s*. This accompanies a reaction of an increased magnitude. In particular, polyethylene sheet or polycarbonate sheet is generally used for the surface sheet 3*e*. A relatively thick sheet is used at this end because it is disposed on the surface and its damage upon contact with an external member must be avoided. Accordingly, the sheet itself has a high reaction, and thus there has been a disadvantage that the first step switch has a relatively high on-load. As a consequence, there have been occurrences that the second step switch becomes turned on as the first step switch is attempted to be turned on, as mentioned previously. It would be greatly convenient if an operation of the first step key switch which is required to select a given display on the display screen while viewing a display condition, principally a display condition on the display screen of a portable telephone, a personal computer, a vehicle onboard instrument and the like could be achieved by tangibly feeling a key operation surface with a finger, for example, or by slipping the finger along the key operation surface. However, such has been a difficult task to achieve with a conventional two-step switch unit.

An example of a conventional depression responsive single step switch unit will be described below with reference to FIG. 23. This switch unit is disclosed in Japanese Patent No. 3,306,311 (issued Jul. 24, 2002). As a depressing piece 60 is depressed, a flexible sheet 61 becomes flexed, and a frame-shaped cushion member 62 as may be formed of urethane foam and on which the flexible sheet 61 is applied is increasingly squeezed, and a driving piece 63*a* of a driver 63 which is formed of a synthetic resin material and which is mounted on the internal surface of the flexible sheet 61 comes into contact with a click plate 64. When a load applied to the click plate 64 exceeds a given value, there occurs a reversal in the central portion of the click plate 64 as shown in FIG. 23B, whereby a membrane switch 6*s* is depressed to turn the switch on.

When the depressing piece is released from the depression, the flexible sheet 61 and the cushion member 62 which have undergone an elastic deformation return to their original configurations due to their respective resilience, and the click plate 64 also returns to its original configuration due to its resilient restoring force, whereby the switch assumes a turn-off condition. It is to be noted that a baseplate 65 is mounted on the surface of the frame-shaped cushion member 62 which is opposite from the flexible sheet 61 with the interposition of a sheet which defines the membrane switch 6*s*. In other words, the membrane switch 6*s* and the click plate 64 are secured to the baseplate 6*s* within an extent defined by the frame-shaped cushion member 62.

In the conventional depression responsive switch unit mentioned above, because the flexible sheet 61 on which the depressing piece 60 is mounted is secured to the cushion member 62, a drive to the click plate 64 may not take place in a satisfactory manner if a depressing force applied to the depressing piece 60 deviates from a direction which is perpendicular to the flexible sheet 61. Alternatively, if a depression is applied to one end of the depressing piece 60, the cushion member 62 will be strongly compressed toward the depressed end while it will be expanded toward the other end, causing the driver 63 to assume a relatively largely tilted position relative to the baseplate 65, preventing a drive from being transmitted satisfactorily to the click plate 64. In either instance, a load which is required to produce a reversal of the click plate 64 becomes higher than for a normal depression. This leads to problems that a clicking sensation is degraded, that a reversal may be prevented from occurring or that the useful life of the click plate 64 may be shortened.

Generally, a switch having a lower peak of on-load has a long useful life because the stresses to which the switch is subject in order to provide the clicking sensation and because the stresses to which the switch is subject from a return spring during the reversal are both small. However, if the reversal occurs as a result of a high load applied to the return spring which would occur during an edgewise depression, the return spring will be subject to correspondingly higher stresses, thus shortening the useful life.

Another example of conventional single step depression responsive switch unit will be described with reference to FIGS. 24 and 25. A depressing piece 72 faces externally through an opening 71*b* formed in a surface plate 71*a* of a case 71. When the depressing piece 72 is depressed into the case 71, a rib 72*a* formed on the peripheral surface of the depressing piece 72 is guided by a guide groove 71*d* of a tubular guide 71*c* which is integrally formed inside the case 71, thus moving toward a rear plate 71*e* of the case 71 in a direction perpendicular thereto. As a result of such movement, an actuator 73*f* of a tact switch 73 which is mounted centrally on the internal surface of the rear plate 71*e* is driven into a switch case 73*b* by a projection 72*c* which is formed centrally on the internal surface of a top plate of the depressing piece 72, whereupon an internal spring is reversed to turn the tact switch 73 on. When the depressing piece 72 is released from the depression, the original configuration is restored due to the resilient restoring force of the spring within the tact switch 73, and the depressing piece 72 is returned to its original position. It is to be noted that the rear plate 71*e* of the case 71 is detachable, and a screw 74 is passed through a bore 71*f* formed in the rear plate 71*e* and is screwed into a bore 71*g* formed in the end face of a sidewall 71*i* of the case 71, whereby the rear plate 71*e* is secured to the sidewall 71*i*.

With this conventional depression responsive switch unit, the depressing piece 71 moves in a direction perpendicular to the rear plate 71*e* if the depression is directed obliquely and if the depression is applied to one end of the depressing piece 71. However, a friction acting between the rib 72 and the guide groove 71*d* increases, and it becomes necessary to increase the depressing force. A switch operation may be prohibited for a depressing force of an equal magnitude. A problem relating to the sensation of operation remains in a similar manner as in the arrangement of FIG. 23. In addition, the arrangement may become larger in size because of a guide construction for the depressing piece 72.

It is an object of the present invention to provide a depression responsive switch unit which is capable of minimizing an on-load for a plurality of first step switches.

It is another object of the present invention to provide a depression responsive switch unit which is hardly influenced by a deviation in the direction of depression or a biased depression.

SUMMARY OF THE INVENTION

The present invention relates to a two step depression responsive switch unit in which a second step switch is interposed between a movable reinforcing plate and a case surface plate within a case and in which a plurality of first step switches are disposed on a case front side of the reinforcing plate. According to one aspect of the present invention, there is provided a knob which depresses the second step switch. The knob includes depressing pieces, each corresponding to the first step switch and formed on an elastic sheet which is extremely pliable as formed by a thermoplasitc elastomer or silicone rubber. Each depressing piece has a depressed surface and also has a small projection which projects in the opposite direction from the depressed surface so as to move close to or into contact with a corresponding one of the first step switches. Each depressing piece is located in an opening which is formed in a key operation base so as to receive a depressing piece. Each depressed surface is located outside the surface of the key operation base, and the reinforcing plate, the elastic sheet and the key operation base are held within the case so as to be simultaneously movable toward the rear plate of the case, and the marginal portion of the elastic sheet is secured to either one of the case, the key operation base and the reinforcing plate.

With this construction, when one of the depressing pieces is selected to be depressed gently, the elastic sheet is deformed (flexed) to turn one of the first step switches on. If the depression is further continued, the reinforcing plate moves to turn the second step switch on. The on-load of the first step switch principally comprises a reaction from only the elastic sheet which is extremely pliable. Since the elastic sheet is constructed with a thermoplastic elastomer or a silicone rubber, its reaction is considerably smaller as compared with the reaction of a single surface sheet which comprises polyethylene sheet or polycarbonate sheet used in the prior art. Accordingly, with the switch unit according to one aspect of the present invention, an operation of the first step switch can be made without any particular attention to a distinction between the operation of the first step switch and the operation for the second step switch, or without any need to be conscious not to operate the second step switch when the first step switch is to be operated. With the switch unit according to one aspect of the present invention, the first step switch can be turned on by tangibly feeling the key display surface with a finger or slipping the finger along the key display surface, for example.

According to another aspect of the present invention, there is provided a depression responsive switch unit in which a depression of a knob turns a switch on. According to this aspect of the present invention, the knob is disposed within an opening formed in a surface plate of a rigid body, and a switch is disposed between the knob and the case rear plate. The knob is retained in the case by a resilient member such that it is readily displaceable in the direction of a normal depression, but is hardly displaceable in a direction perpendicular to the direction of the normal depression.

In the switch unit according to the second aspect of the present invention, the case comprises a rigid body, and even though there is no guide means for the knob, the retaining function of the resilient member is such that if the direction of depression deviates from the normal direction, and if one end of the knob is depressed, the switch can be reliably turned on. In addition, a return spring has an increased useful life and could be constructed in a compact manner.

BRIEF DESCRIPTION OF THE DRAWINGS

FIG. 3B is an enlarged section corresponding to FIG. 3A and illustrating when a tact switch 7 is turned on.

FIG. 9A is a cross section similar to FIG. 4, illustrating the first embodiment when the first step switch is turned on;

FIG. 9B is a cross section similar to FIG. 4, illustrating the first embodiment when the second step switch is turned on;

FIG. 17A is a cross section corresponding to FIG. 11, illustrating the third embodiment when the first step switch is turned on;

FIG. 17B is a cross section corresponding to FIG. 11, illustrating the third embodiment when the second step switch is turned on;

FIG. 23B is a cross section of a switch shown in FIG. 23A when it is turned on;

DESCRIPTION OF MODES OF CARRYING OUT THE INVENTION

Figure 1:
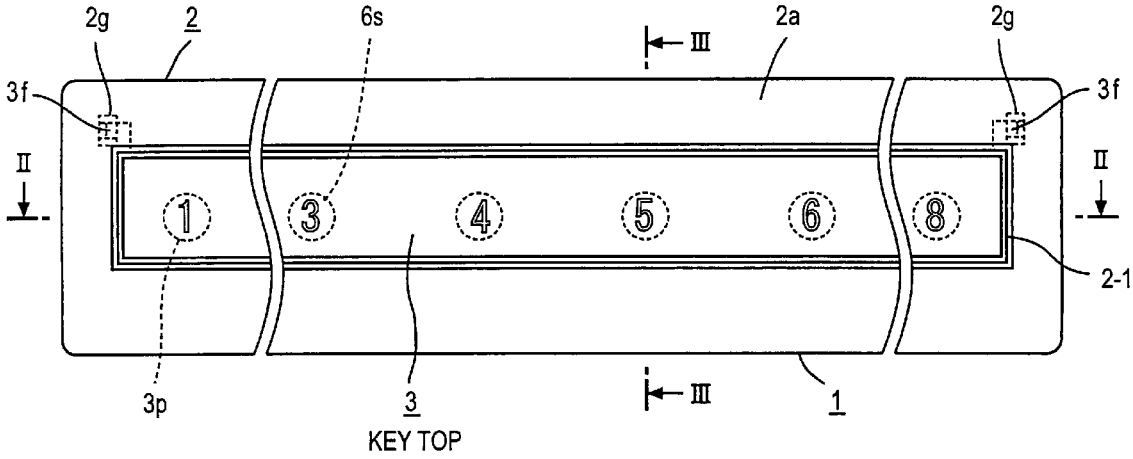
FIG. 1 PRIOR ART
FIG. 1 is a plan view showing an example of a conventional two-step switch unit.

First Mode of Carrying Out the Invention

A first mode of carrying out the present invention is a depression responsive two-step switch unit in which the marginal portion of the elastic sheet is carried by a case.

The first mode of carrying out the present invention will be briefly described with reference to FIG. 4. In the example shown, a second step switch 36 is disposed on a rear plate 39*h* within a case 39 and a reinforcing plate 35 is disposed on top of the second step switch 36. A plurality of first step switches 34*s* are disposed on the reinforcing plate 35. A key operation base 33 is disposed on the side of the reinforcing plate 35 which is located toward the first step switch 34*s*. At locations corresponding to each of the first step switches 34*s*, the key operation base 33 is formed with depression openings 33*a* extending therethrough. A knob 32 is disposed on the front side of the key operation base 33.

The knob 32 includes depressing pieces 32*a* which are formed on an extremely pliable elastic sheet 32*c* which comprises a thermoplastic elastomer or a silicone rubber at locations corresponding to one of the first step switches 34*s*, and each depressing piece 32*a* has a depressed surface 32*a*2 which is located forwardly of the elastic sheet 32*c*. Each depressing piece 32*a* is at least partly located within the depression opening 33*a* formed in the key operation base 33 and includes a small projection 32*b* which projects from the surface opposite from the depressed surface 32*a*2. Each small projection 32*b* is located close to or is in contact with a corresponding one of the first step switches 34*s*. The marginal portion 32*d*of the elastic sheet 32*c* is retained by the case 39. In the example shown, the case 39 comprises a rear plate 39*h*, sidewalls 39*a* and 39*d* which are integral therewith, and a cover 31 which abuts against and which is secured to the end faces of the sidewalls 39*a* and 39*d* to serve as a front plate. The marginal portion 32*d* of the elastic sheet 32*c* is held sandwiched between the cover (front plate) 31 and the sidewall 39*a* to be retained by the case 39.

The knob 32 and the key operation base 33 are secured together as are the first step switches 34*s* and the reinforcing plate 35, whereby they are simultaneously reciprocable with respect to the rear plate 39*h*. In the example shown, the second step switch 36 is constructed to be automatically reset when it is released from the depression or assumes a turn-off condition while desirably providing a clicking sensation or a sensation that a switch operation has been made.

First Embodiment

A first embodiment as a specific example of the first mode of carrying out the present invention will now be described. It should be understood that in the description to follow, corresponding parts which appear throughout the drawings are designated by like reference numerals in order to avoid a duplicated description as much as possible.

Figure 4:
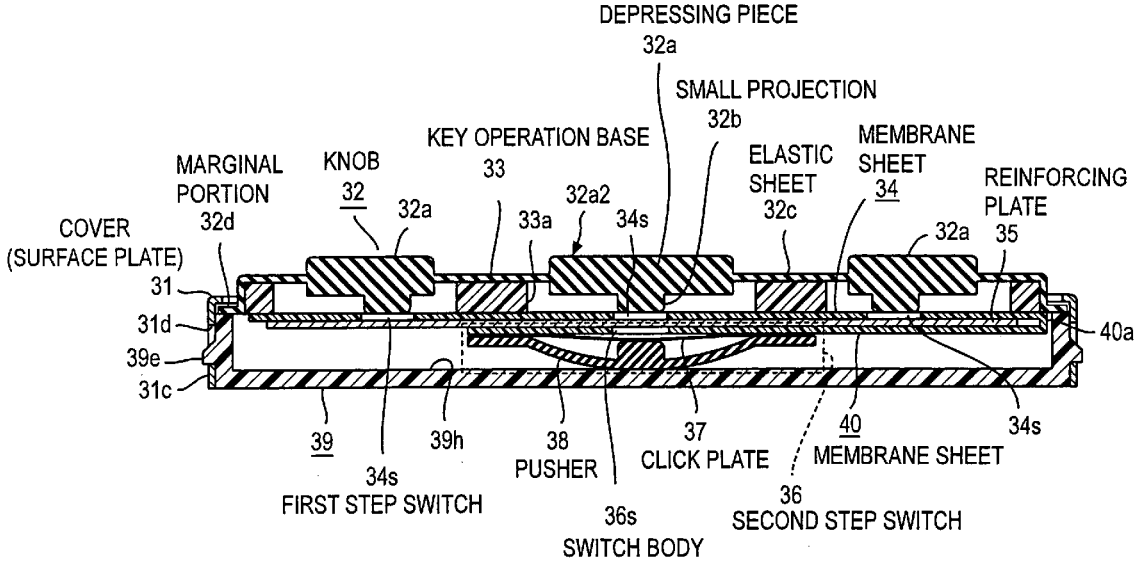
FIG. 4 is a cross section taken along the line IV—IV shown in FIG. 5 which illustrates a first embodiment of the present invention.
Figure 5:
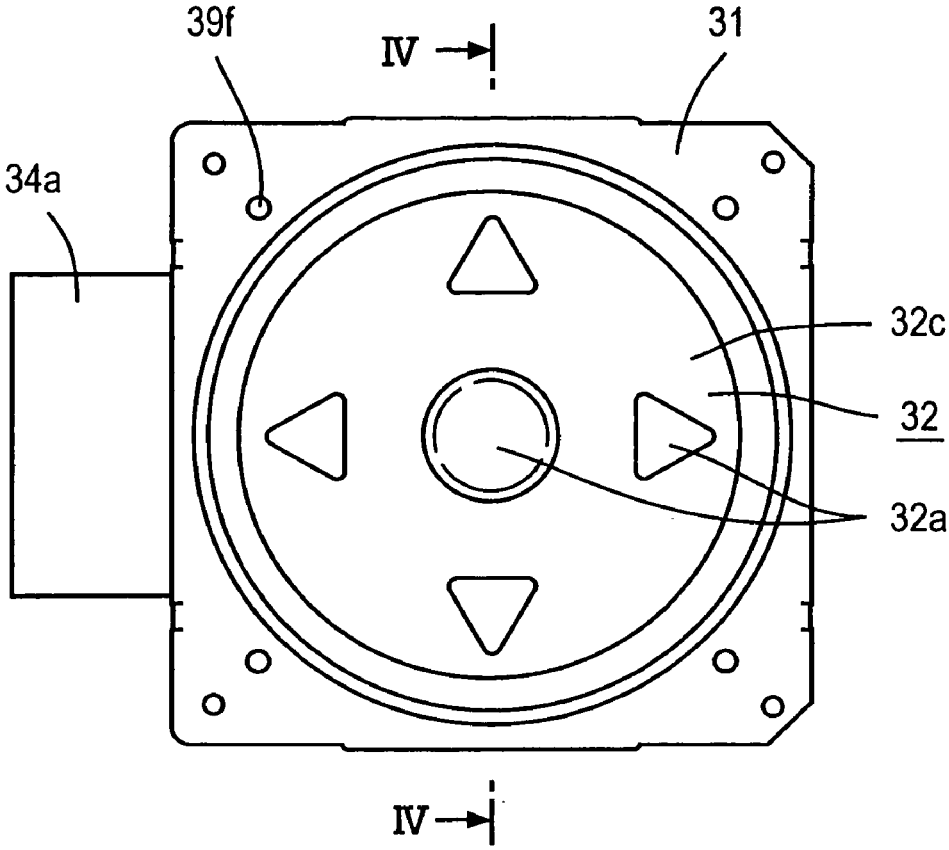
FIG. 5 is a top view of the first embodiment.
Figure 6:
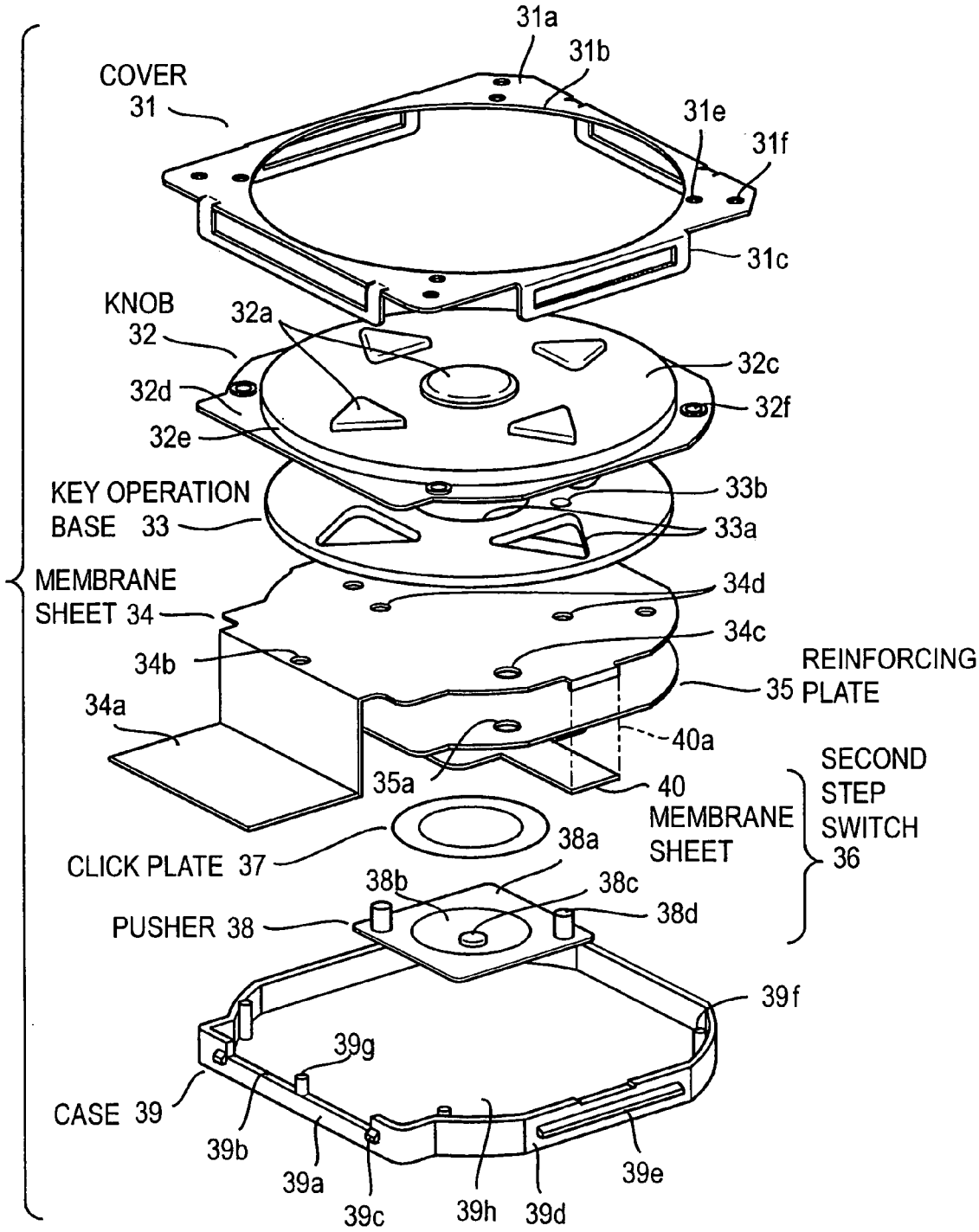
FIG. 6 is an exploded perspective view of the first embodiment.

A cross section of the first embodiment taken along the line IV—IV shown in FIG. 5 is shown in FIG. 4, a plan view is shown in FIG. 5, and the exploded perspective view is shown in FIG. 6.

A cover (front plate) 31 comprises a metal sheet which is machined as required, and includes a square portion 31*a* in which a circular opening 31*b* is formed. Each side of the square portion 31*a* has a U-shaped detent 31*c* having short limbs which is bent in a direction perpendicular to the square portion 31*a* to extend toward the rear plate 39*h*.

A knob 32 comprises a square-shaped elastic sheet 32*c*, which extends outside the opening 31*b* formed in the cover 31 except for its marginal portion 32*d* to define a circular top surface on which five depressing pieces 32*a* are formed as projections in this example. One of the depressing pieces 32*a* which is located centrally has a circular configuration, while the depressing pieces 32*a* which are located laterally on the opposite sides of the central depressing piece 32*a* are triangular in configuration. The internal surface of each depressing piece 32*a* projects beyond the elastic sheet 32*c* toward the rear plate 39*h* as shown in FIG. 4, and a small projection 32*b* is formed centrally on the end face of the projection. In this example, the depressing piece 32*a*, the small projection 32*b* and the elastic sheet 32*c* are integrally molded with a thermoplastic elastomer, and thus is constructed with an extremely pliable material.

The key operation base 33 is molded from a hard resin such as ABS resin or polycarbonate and is in the form of a disc which corresponds to the circular top surface of the knob 32. The key operation base 33 is formed with depression openings 33*a* which extend therethrough at locations corresponding to each depressing piece 32*a* of the knob 32 and which are larger than the depressing piece 32*a*. The centrally disposed depression opening 33*a* is circular in the similar manner as the depressing piece 32*a* which corresponds thereto while the remaining depression openings 33*a* are triangular in configuration. While the key operation base 33 and the knob 32 are shown separately in FIG. 6, in the present example, they are integrally molded, and the elastic sheet 32*c* is secured to the key operation base 33 without any slack therebetween.

In the present example, the first step switch 34*s* uses a membrane sheet 34 which is constructed in the similar manner as the membrane sheet 6 of the prior art described above in connection with FIGS. 1 to 3. While not specifically shown in FIGS. 4 to 7, the five membrane switches acting as first step switches 34*s* are formed, each constructed in the similar manner as the membrane switch 6*s* shown in FIG. 3A and having fixed contacts 6*d* and 6*e* and the movable contact 6*f*. In FIG. 4, such first step switches (membrane switches) 34*s* are indicated by blank areas (the same is true for a corresponding membrane switch). A tail 34*a* which is used to take out the lead wire for each of the fist step switches 34*s* is connected to part of the peripheral edge of the membrane sheet 34.

A reinforcing plate 35 comprises a stainless steel sheet, for example, and has substantially similar configuration as the membrane sheet 34.

Figure 3A:
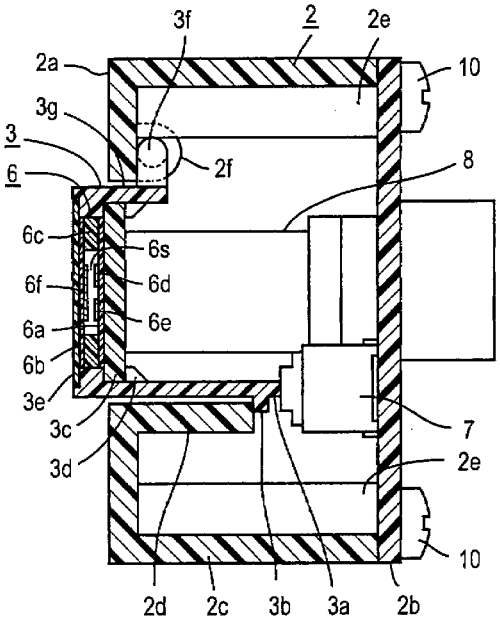
PRIOR ART FIG. 3A
FIG. 3A is an enlarged section taken along the line III—III shown in FIG. 1.
Figure 3B:
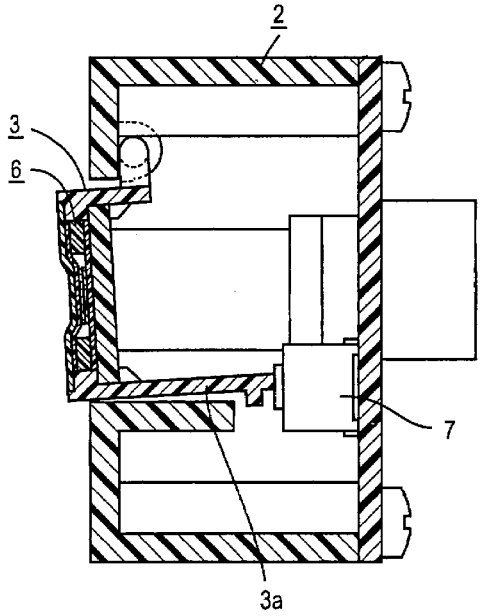

The second step switch 36 shown in this example comprises a switch body 36*s* which is constructed in the similar manner as the membrane switch 36*s* shown in FIG. 3, for example, a click plate 37 and a pusher 38. The membrane sheet 40 on which the membrane switch 36*s* acting as a switch body is constructed is shown in FIG. 6 as being separate from the membrane sheets 34, but they are integrally formed through a connector 40*a* as shown in FIG. 4, and the connector 40*a* is folded to place the membrane sheets 34 and 40 on the opposite sides of the reinforcing plate 35. The membrane sheet 36*s* acting as the switch body is also shown as a blank area in FIG. 4 (the same applies for a similar switch).

In the present example, an arrangement is made to provide a clicking sensation from a switch operation of the second step switch 36 in a manner mentioned previously, and the click plate 37 is disposed in the region of the membrane switch (switch body) 36*s* of the membrane sheet 40 on the opposite side of the reinforcing plate 35. The click plate 37 comprises a dish-shaped springy metal sheet.

A pusher 38 is interposed between the click plate 37 and the rear plate 39*h* so that a restoring force acts automatically when the second step switch 36 is released from the depression. The pusher 38 may be formed of rubber, for example, and has a square-shaped flat plate 38*a* which is centrally formed with a dome 38*b* which projects toward the rear plate 39*h*. A projection 38*c* is formed centrally on the internal surface of the dome 38*b* so as to project toward the click plate 37.

The case 39 is formed of a hard resin such as ABS resin or polycarbonate and is open toward the front, and is in the form of a shallow square, with each corner being rounded. The sidewall 39*a* which forms one side of the square is somewhat extended externally, and a notch 39*b* is formed in its end face which is disposed toward the front side. This illustrates an arrangement to allow the tail 34*a* to be guided externally. In order to fasten the case 39 and the cover 31 together, a pair of small detent tabs 39*c* are formed on the external surface of the sidewall 39*a* while the external surface of the sidewalls 39*d*, which form the remaining three sides of the square, is formed with a detent projection 39*e* of a substantial length which extends along the respective side.

In order to allow the knob 32 to be positioned when mounting it on the case 39, in the present example, a boss 39*f* is fixedly mounted on the rear plate 39*h* at a location close to the internal surface of each rounded corner of the case 39. The marginal portion 32*d* of the knob 32 and the top plate 31*a* of the cover 31 are formed with openings 32*f* and 31*e*, respectively, through which the bosses 39*f* can be passed. A boss 39*g* is formed centrally on the notch 39*b* of the case 39 on its front side, and an opening 34*b* is formed in an end of the membrane sheet 34 which is located toward the tail 34*a* for passing the boss 39*g*. It is to be noted that openings 31*f*, which are formed radially outward of the four openings 31*e* in the cover 31 are used for purpose of mounting the two-step switch unit.

In order to position and secure the membrane sheet 34 of the key operation base 33 and the reinforcing plate 35 relative to each other, a pair of bosses are formed on the key operation base 33 on the side which faces the rear plate 39*h* in this example, even though such bosses are hidden from sight in FIG. 6, and the membrane sheet 34 and the reinforcing plate 35 are formed with a pair of openings 34*c* and 35*a*, respectively, for passing these bosses.

In order to position and secure the membrane switch (switch body) 36*s* of the membrane sheet 40, the click plate 37 and the pusher 38 relative to each other, in the present example, the flat plate 38*a* of the pusher 38 is formed with a pair of bosses 38*d*, and openings which pass these bosses 38*d* are formed in the reinforcing plate 35, the membrane sheet 34 and the key operation base 33. Numerals 34*d* and 33*b* shown in FIG. 6 shows such openings. It should be noted that the openings formed in the reinforcing plate 35 for passing the bosses 38*d* are hidden from sight.

The assembly of parts mentioned above will now be described.

Initially, the assembly of the knob will be sequentially described.

(1) As mentioned previously, the knob 32 and the key operation base 33 are integrally formed as a result of their molding, and the membrane sheet 34 and the reinforcing plate 35 are secured on the rear side of the key operation base 33. This securing operation takes place by passing the bosses which are formed on the rear side of the key operation base 33 into the pair of openings 34*c* formed in the membrane sheet 34 and through the pair of openings 35*a* formed in the reinforcing plate 35 and by caulking the free ends of the bosses by heat. This assembly will be more apparently seen by reference to FIG. 15 which illustrates a similar assembly which takes place in a third embodiment to be described later.

(2) The membrane sheet 40 which is integral with the membrane sheet 34 is secured to the rear side of the reinforcing plate 35 by using a both side adhesive, for example, to adhesively secure them.

(3) The click plate 37 is disposed on the rear side of the membrane sheet 40 with its center aligned with the position of the membrane switch 36*s* in a manner such that the rear side is convex. The click plate 37 is positioned and secured to the membrane sheet 36 as by covering it with an adhesive tape, for example.

(4) The pusher 38 is disposed on the rear side of the click plate 37. The pusher 38 has a pair of bosses 38*d*, which are sequentially passed through openings in the reinforcing plate 35, the openings 34*d* in the membrane sheet 34 and the openings 33*b* in the key operation base 33 to be a press fit therein, whereby the pusher 38 is positioned relative to the click plate 37 and is secured to the key operation base 33. This completes the assembly of the knob.

Figure 7:
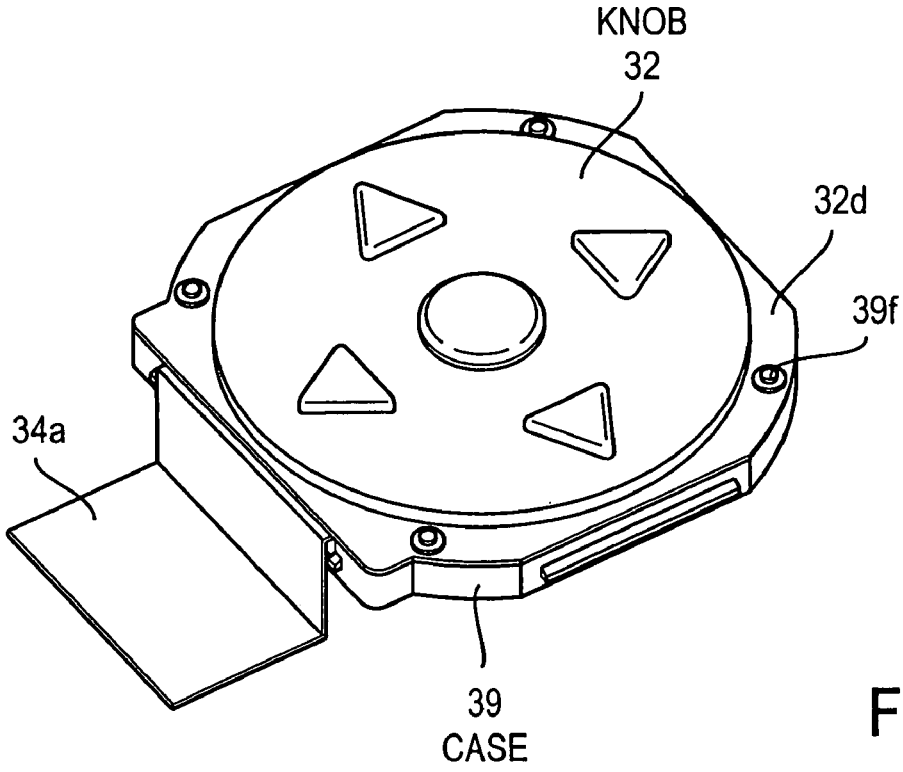
FIG. 7 is a perspective view of the first embodiment before the cover is attached.

Subsequently, the knob assembly is assembled into the case 39. This assembling operation takes place by passing the bosses 39*f* on the case 39 through the four openings 32*f* formed in the marginal portion 32*d*of the knob 32 and passing the boss 39*g* on the case 39 through the opening 34*b* formed in the membrane sheet 34. In this manner, the knob assembly is positioned and received within the case 39. FIG. 7 shows this condition.

Finally, the cover 31 is attached to complete the two-step switch unit. The cover 31 is attached by engaging four detents 31*c* with the detent projections 39*c* and 39*e* of the case 39.

Figure 8:
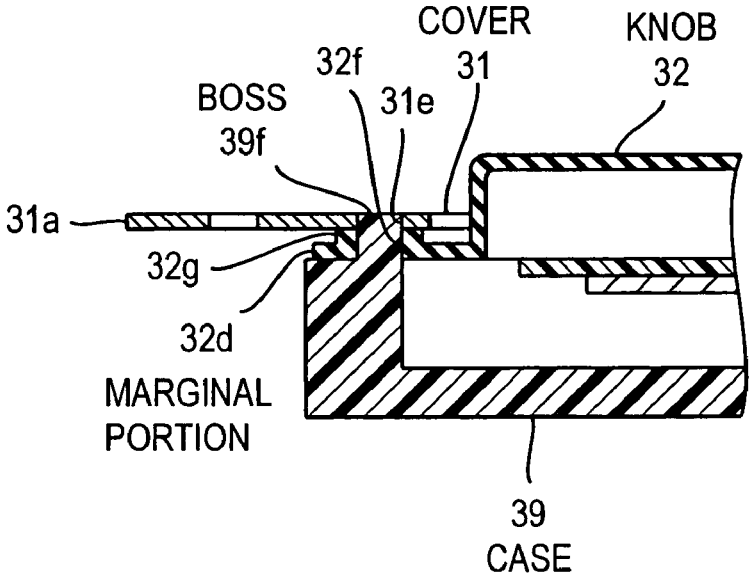
FIG. 8 is a cross section illustrating that the knob and the cover are positioned by bosses on the case in the first embodiment.

FIG. 8 shows, to an enlarged scale, one location where the marginal portion 32*d* of the knob 32 and the square portion 31*a* of the cover 31 are positioned by the bosses 39*f* on the case 39. The cover 31 is positioned by passing the opening 31*e* thereof over the boss 39*f*, and the periphery of the knob 32 or the marginal portion 32*d*of the elastic sheet 32*c* is held sandwiched between the case 39 and the surface plate or the cover 31 to be retained by the case 39.

In the example shown in FIG. 8, a ring-shaped rib 32*g* is formed around the opening 32*f* in the periphery of the knob 32 (or the marginal portion of the elastic sheet) 32*d* on the side which faces the cover 31, and the square portion 31*a* of the cover 31 abuts against the marginal portion 32*d*of the knob 32 only at this ring-shaped rib 32*g* while a small clearance is maintained with respect to the marginal portion 32*d* in the remainder.

The two-step switch unit which is assembled in the manner mentioned above has a construction as shown in FIG. 4 where the pusher 38 is located centrally on the internal surface of the rear plate 39*h* of the case 39, and the click plate 37, the reinforcing plate 35 which carries membrane sheets 34 and 36 on the opposite sides and the key operation base 33 which is integral with the knob 32 are sequentially mounted thereon.

The knob 32 or the elastic sheet 32*c* thereof is disposed on the front side of the key operation base 33 and its marginal portion 32*d* is supported by the case 39, substantially blocking the opening in the case 39 by the knob 32. In this example, it is secured to the case 39 at a plurality of locations (which are four locations as shown), and other non-anchored portions remain to be free ends.

Figure 9A:
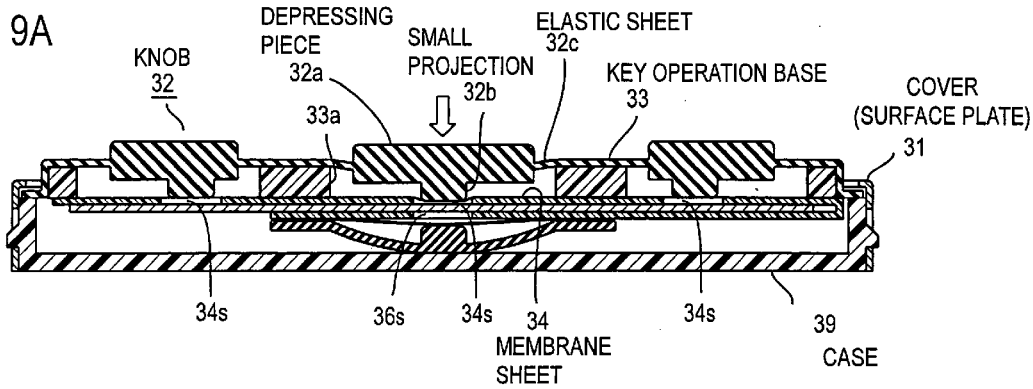

The operation of the two-step switch unit according to the first embodiment will now be described. When any desired one of the depressing pieces 32*a* of the knob 32, for example, a central depressing piece is gently depressed, the elastic sheet 32*c* located around this depressing piece 32*a*, namely, the portion of the elastic sheet 32*c* which is located between the peripheral edge of the depression opening 33*a* and the depressing piece 32*a* becomes flexed as shown in FIG. 9A, thus depressing the small projection 32*b*. The membrane switch 34*s* which serves as the first step switch is depressed by the small projection 32*b*, whereby the contacts (not shown) which are located opposite thereto contact each other to turn the first step switch 34*s* on.

Figure 9B:
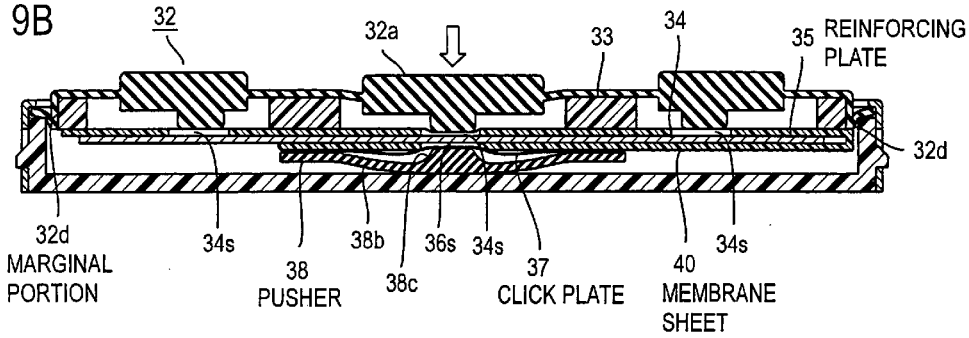

When the depressing piece 32*a* is further depressed, the marginal portion 32*d* of the knob 32 becomes flexed as shown in FIG. 9B, and the key operation base 33 which is integral with the knob 32, the reinforcing plate 35 which holds the membrane sheets 34 and 40 and the click plate 37 are depressed in an integral manner, thus depressing the pusher 38.

The dome 38*b* of the depressed pusher 38 is squeezed to deform in a manner shown in FIG. 9B, whereby the projection 38*c* of the pusher 38 presses against the click plate 37. The click plate 37 which is pressed in this manner has its central portion reversed in position relative to the peripheral surface of the click plate 37 (hereafter such phenomenon will be simply referred to as a reversal) with a click sensation, thus pressing against the membrane switch 36*s* which serves as the switch body of the second step switch. When the click plate 37 presses against the membrane switch 36*s*, the contacts (not shown) which are located opposite thereto contact each other to turn the second step switch 36 on.

When this pressing action is gradually released, the resilient restoring force of the pusher 38, the click plate 37 and the marginal portion 32*d* of the knob 32 causes the parts which have been depressed in an integral manner to return to their original positions to turn the second switch 36 off. When the depression is completely released, the depressing piece 32*a* and the small projection 32*b* return to their original positions relative to the key operation base 33 under the influence of the restoring force of the membrane sheet 34 to turn the first step switch 34*s* off.

In the present example, the membrane switch 34*s* which serves as the first step switch is disposed within the switch unit, and accordingly, contacts can be formed on a very thin film, for example, a polyethylene film by a printed circuit technology, allowing the reaction thereof to be minimized. In addition, since the first step switch is turned on by a flexure of only the elastic sheet 32*c* which comprises a pliable thermoplastic elastomer, the on-load of the first step switch can be minimized. More specifically, in the two-step switch unit of this embodiment, the key operation surface is constructed by the key operation base 33 which retains the knob 32, and accordingly, the first step switch can be turned on with a contact of the finger with the depressing piece which is on the order of tangibly feeling the key operation surface with the finger. In addition, the profile of the knob 32 is maintained by the key operation base 33 without any likelihood of being damaged upon contact with an external member while maintaining the key operation surface.

In addition, the switch bodies of the first and the second step switch are both formed by the membrane sheets 34 and 40, respectively, in the present example, allowing a thin and compact construction while reducing the number of steps of assembly to permit the switch unit to be constructed inexpensively.

Furthermore, in the example shown, the peripheral portion of the elastic sheet 32*c* or the marginal portion 32*d* of the knob 32 is not secured to the case 39 along the full perimeter thereof, but is secured by being positioned at a plurality of points which are four points representing the bosses 39*f* of the case 39 in this example, whereby a construction is achieved which allows an elastic deformation of the marginal portion 32*d* to occur readily in the direction of depression while making an elastic deformation in a direction perpendicular to the direction of depression or in a direction parallel to the rear plate 39*h* hardly occurring. In other words, the knob 32, the key operation base 33 and the reinforcing plate 35 are readily displaceable in the direction of a normal depression, but are hardly displaceable in a direction perpendicular to the direction of a normal depression. Thus, when the knob 32 is depressed, an adequate degree of tension occurs in the marginal portion 32*d* as a result of securing at a plurality of points which are four points in the present example, and if another depressing piece 32*a* is depressed, or if the knob 32 is edgewise depressed, a rotation of the key operation base 33 about the point of contact between the pusher 38 and the rear plate 39*h* is unlikely to occur. In addition, if the knob 32 were depressed obliquely with respect to the direction of a normal depression, the second step switch can be depressed under a condition that the key operation base 33 assumes a small inclination, affording a good touch and an evenly stroking sensation at this point. In addition, because the key operation surface is defined by the knob 32 of an elastic material which comprises a thermoplastic elastomer, additional effects are obtained that it is comfortable to touch and there is a high grade leather-like appearance.

Second Embodiment

Figure 10:
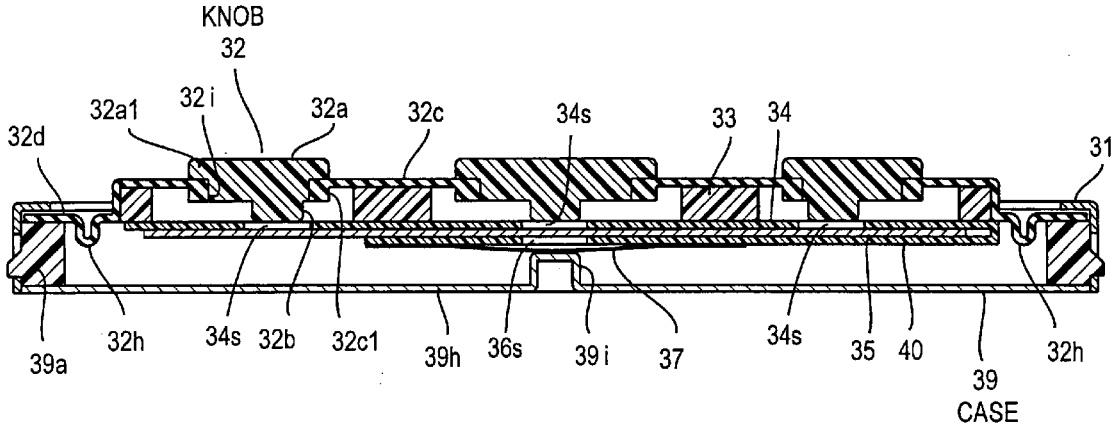
FIG. 10 is a cross section corresponding to FIG. 4 for a second embodiment.

In the second embodiment, in order to reduce the number of parts, a sidewall 39*a* is molded integrally with a knob 32 as shown in FIG. 10, and the marginal portion 32*d* of the elastic sheet 32*c* (knob 32) is secured to the end face of the sidewall 39*a* along the full perimeter as by an integral molding. A redundant portion 32*h* which is U-shaped in section is formed in the marginal portion 32*d* of the elastic sheet 32*c* (knob 32) to extend along the inner periphery of the sidewall 39*a*. This facilitates an elastic deformation of the marginal portion 32*d* in a direction toward the rear plate and also makes an elastic deformation in a direction parallel to the rear plate more difficult to occur. In other words, the knob 32, the key operation base 33 and the reinforcing plate 35 are readily displaceable in the direction of a normal depression and are hardly displaceable in a direction perpendicular to the direction of a normal depression. Accordingly, if the knob 32 is edgewise depressed, there occurs no inclination of the knob 32 (the key operating base 33 and the reinforcing plate 35), allowing the second step switch to be operated with a good touch and an evenly stroking sensation. It is to be noted that in the present example, the rear plate 39*h* of the case 39 is formed by a metal sheet in order to reduce the thickness. Securing the marginal portion 32*d* of the elastic sheet 32 to the case 39 over the full perimeter may take place in the example shown in FIGS. 4 to 8 by omitting the ring-shaped rib 32*g* shown in FIG. 8 and holding the marginal portion 32*d* sandwiched between the case 39 and the cover 31 over the full perimeter.

The example shown in FIG. 10 illustrates that the depressing piece 32*a* and the small projection 32*b* of the knob 32 are integrally constructed with a resin material. Specifically, the elastic sheet 32*c* is formed with a passing opening 32*i* in a manner corresponding to each depressing piece 32*a*, and each depressing piece 32*a* is formed by a hard resin such as ABS resin or polycarbonate, with a flange 32*a*1 integrally formed with the depressing piece 32*a* toward a depressed surface 32*a*2 and each depressing piece 32*a* is passed through the corresponding passing opening 32*i* and the flange 32*a*1 is brought into abutment against the elastic sheet 32*c* around the edge of the passing opening 32*i*. In the present example, a surface opposite from the surface against which the flange 32*a*1 around the edge of the passing opening 32*i* abuts is integrally molded with a ring-shaped rib 32*c*1. The elastic sheet 32*c*1 which comprises a thermoplastic elastomer, and the depressing piece 32*a* and the small projection 32*b* which comprise a hard resin are integrally molded to be secured together. By choosing a resin material for the depressing piece 32*a*, a desired feeling as the depressing piece 32*a* is touched when it is to be depressed can be obtained.

In the example shown in FIG. 10, the pusher 38 shown in FIG. 4 is omitted, and a projection 39*i* is integrally formed at the center of the internal surface of the rear plate 39*h*, with the projecting end face of the projection abutting against the central portion of the convex side of the click plate 37. It will be seen that in this instance also, as one of the depressing pieces 32*a* is depressed, the click plate 37 is pressed by the projection 39*i* to reverse, whereby the switch body 36*s* of the second step switch is turned on.

Second Mode of Carrying Out the Invention

Figure 11:
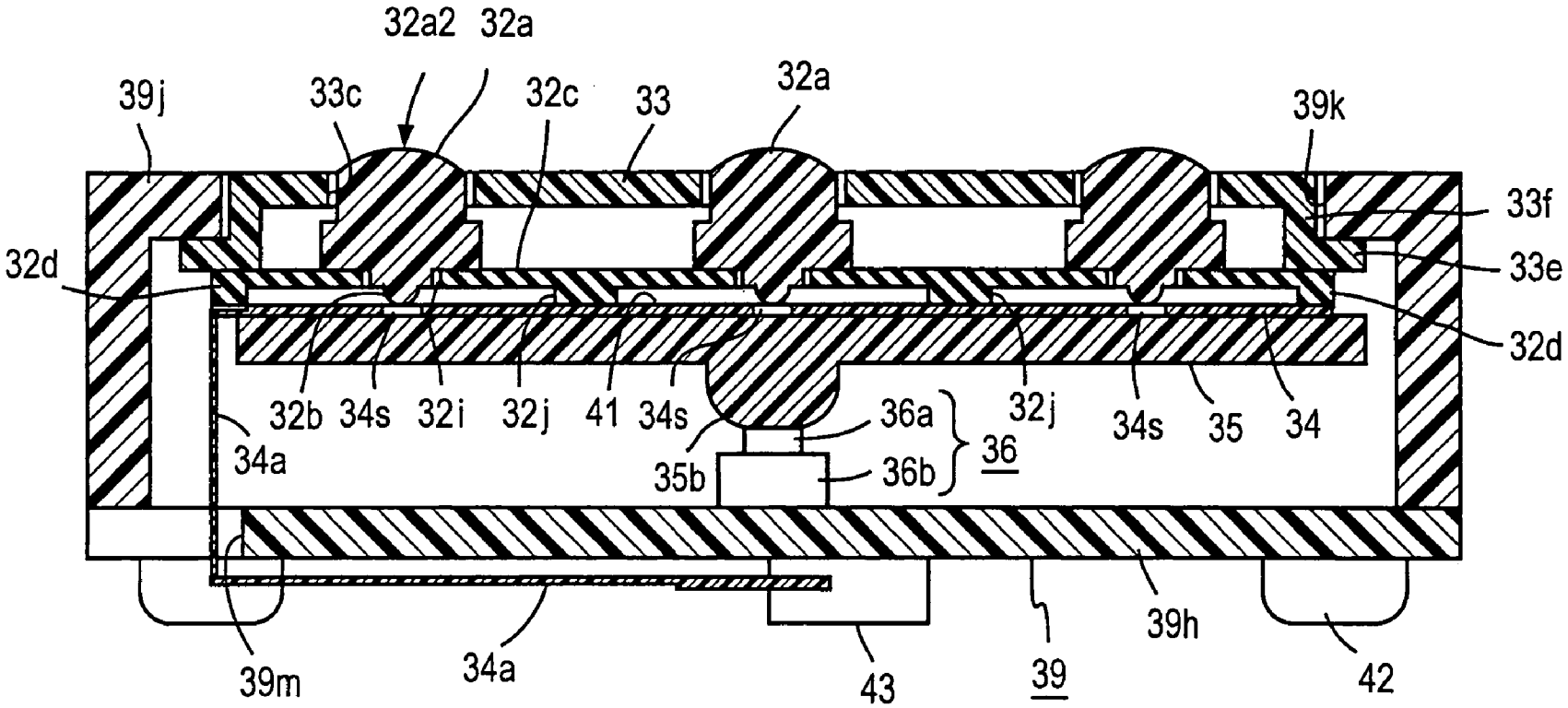
FIG. 11 is a cross section taken along the line XI—XI shown in FIG. 12 illustrating a third embodiment of the present invention.

The second mode of carrying out the present invention is distinct from the first mode of carrying out the invention in that a key operation base 33 is disposed on the front side of an elastic sheet 32*c* and that the elastic sheet 32*c* is retained not by the case, but by the key operation base 33 and a reinforcing plate 35, as indicated in FIG. 11, for example, which illustrates a cross section corresponding to FIG. 4. Specifically, the key operation base 33 is formed with a depression opening 33*c* in a manner corresponding to each depressing piece 32*a*, and the depressing piece 32*a* faces the front side from within the case 39 through the respective depression opening 33*c*. In FIG. 11, a depressed surface 32*a*2 which is configured to be similar to a part of a spherical surface projects externally from the surface of the key operation base 33. There is a close clearance between the peripheral surface of the depressing piece 32*a* and the depression opening 33*c*, and the key operation surface is formed by the surface of the key operation base 33 and the depressed surface 32*a*2 which substantially blocks the depression opening 33*c*. An operator of the two-step switch unit touches the key operation surface with a finger of his hand to operate it for depression. It is not the key operation base 33, but the elastic sheet 32*c* that contacts the reinforcing plate 35 or the membrane sheet 34. The marginal portion 32*d* of the elastic sheet 32*c* is held sandwiched between the key operation base 33 and the reinforcing plate 35 to maintain the elastic sheet 32*c* in a slack-free condition. In other respects, the second mode of carrying out the invention may be fundamentally same as in the first mode of carrying out the invention. A specific example of the second mode of carrying out the invention will now be described as a third embodiment.

Third Embodiment

Figure 12:
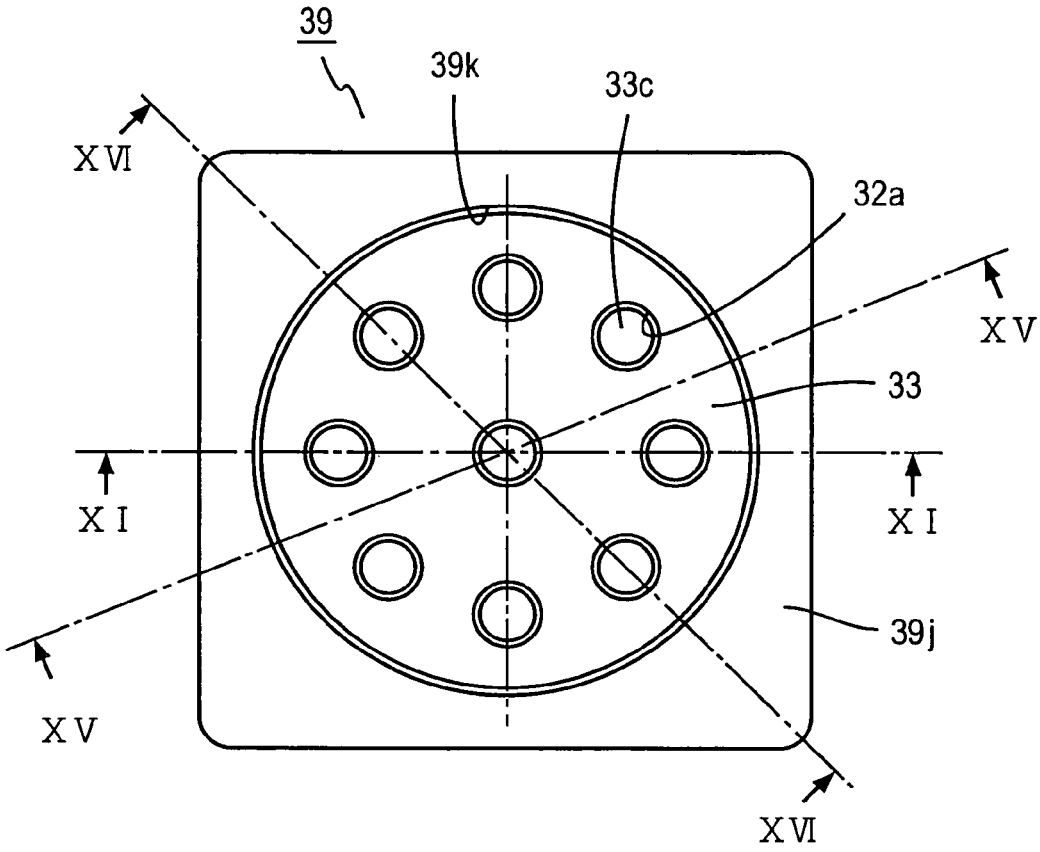
FIG. 12 is a top view of the third embodiment.

The third embodiment is shown in FIGS. 11 to 16. In the third embodiment, instead of the cover 31 shown in the first embodiment, a case 39 is formed with a surface plate 39*j* in an integral manner with its sidewall, and a large circular opening 39*k* is formed in the surface plate 39*j*. A key operation base 33 is disposed to substantially block the opening 39*k*, and the key operation base 33 is formed with a depression opening 33*c* in a manner corresponding to each depressing piece 32*a*. In the present example, there are nine depression openings 33*c* as shown in FIG. 12, one being disposed at the center while the remaining eight openings are disposed on a common circle at an equal interval.

As mentioned previously, in the present example, the depressing piece 32*a* and the small projection 32*b* are integrally molded with a hard resin, and this is adhesively secured to or integrally molded with the elastic sheet 32*c* which comprises a thermoplastic elastomer 32. Each depressing piece 32*a* is disposed in the depression opening 33*c* in the key operation base 33 to face the exterior. Only a depressed surface 32*a*2, which forms a part of spherical surface, is slightly exposed from the surface of the key operation base 33 to permit a finger to contact and to slip along the key operation surface so that the existence of the depression piece 32*a* can be confirmed by tactile impression. The elastic sheet 32*c* is located on the reinforcing plate 35 through the membrane sheet 34 interposed in this instance, and has the small projection 32*b* as the only portion where it contacts a first step switch, which is a membrane switch 34*s* within a membrane sheet 34 in this example.

Figure 14:
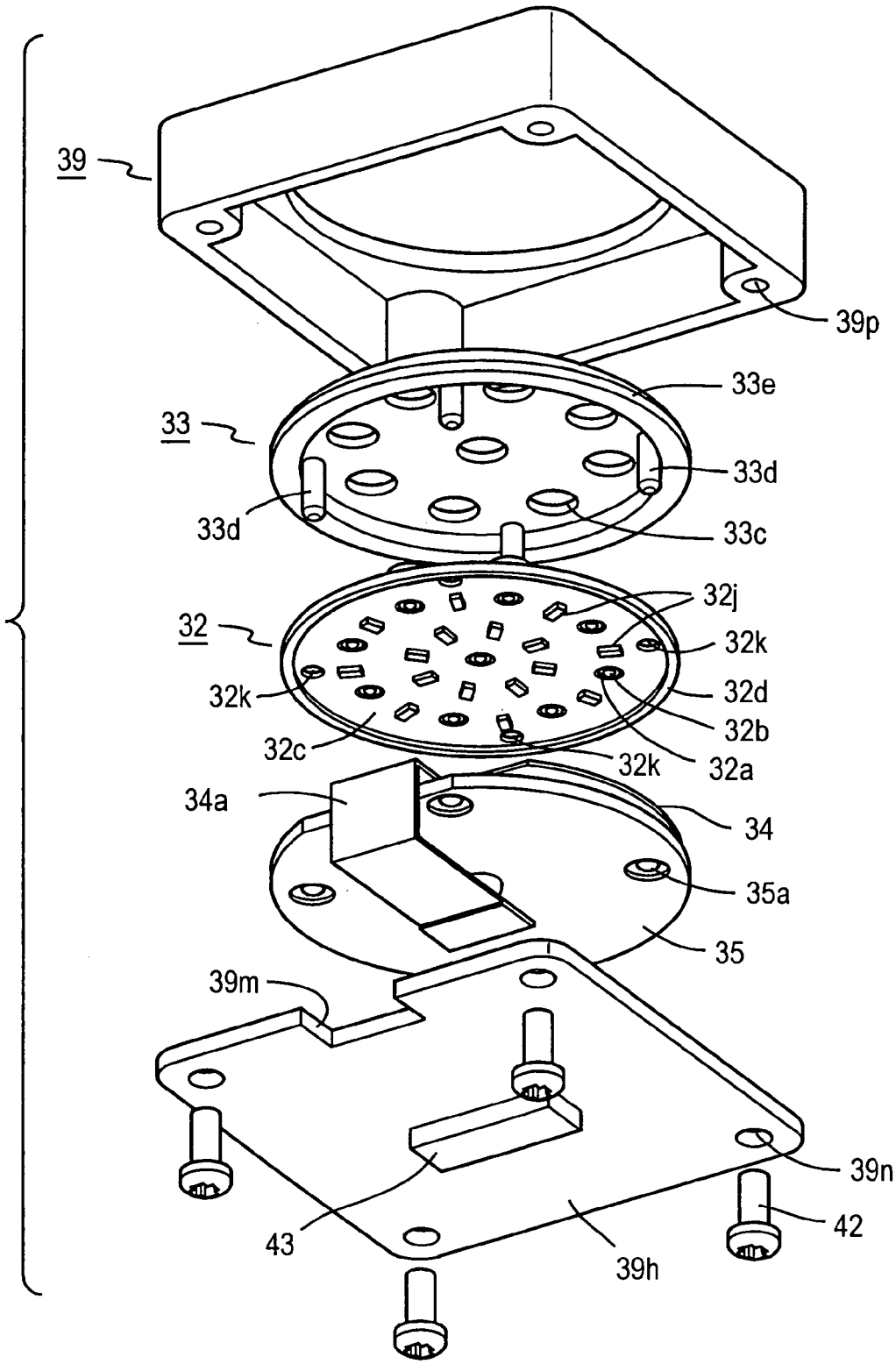
FIG. 14 is an exploded perspective view of the third embodiment as viewed from the rear.
Figure 16:
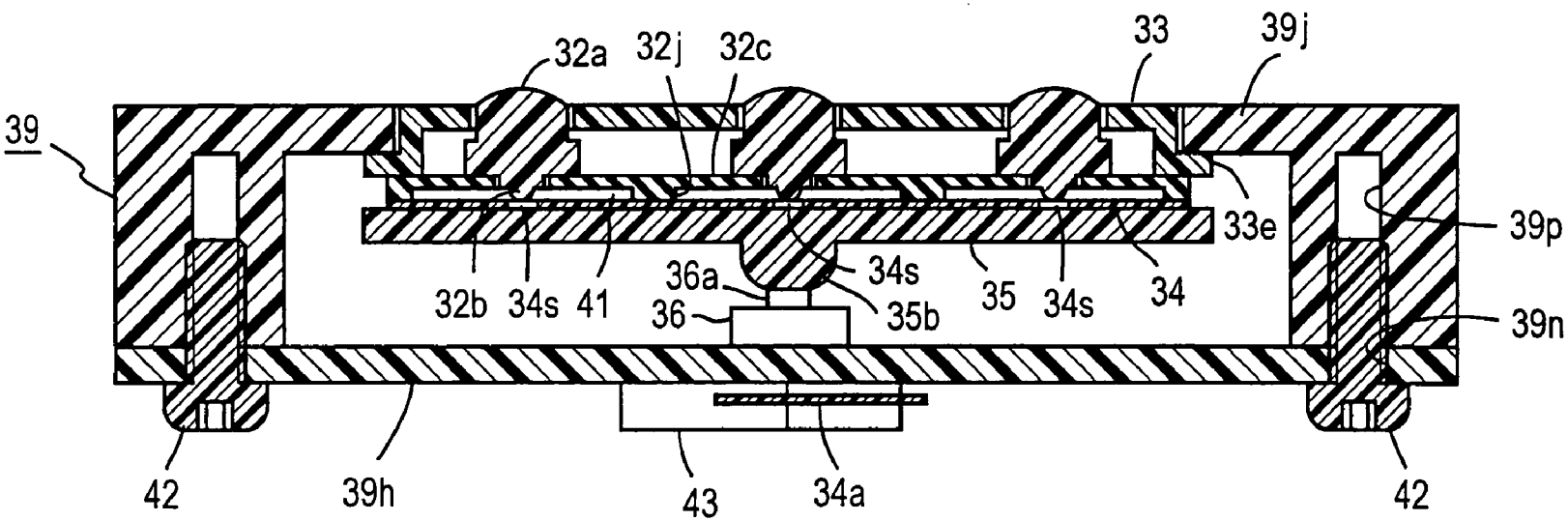
FIG. 16 is a cross section of the third embodiment taken along the line XVI—XVI shown in FIG. 12.

For this reason, an air gap formation 32*j* is formed as a projection on the side of the elastic sheet 32*c* which is disposed toward the reinforcing plate 35 in a manner corresponding to each adjacent small projection 32*b* or to the center position between adjacent membrane switches 34*s*, thus producing an air gap 41 between the elastic sheet 32*c* and the first step switch (membrane switch) 34*s*. As shown in FIGS. 11, 14 and 16, the air gap formation 32*j* is located at a midpoint between adjacent depressing pieces 32*a* as viewed in the direction in which the depressing pieces 32*a* are arrayed. The marginal portion 32*d* of the elastic sheet 32*c* has an increased thickness and defines a ring-shaped air gap formation which is centered about the centrally located depressing piece 32*a*.

Figure 13:
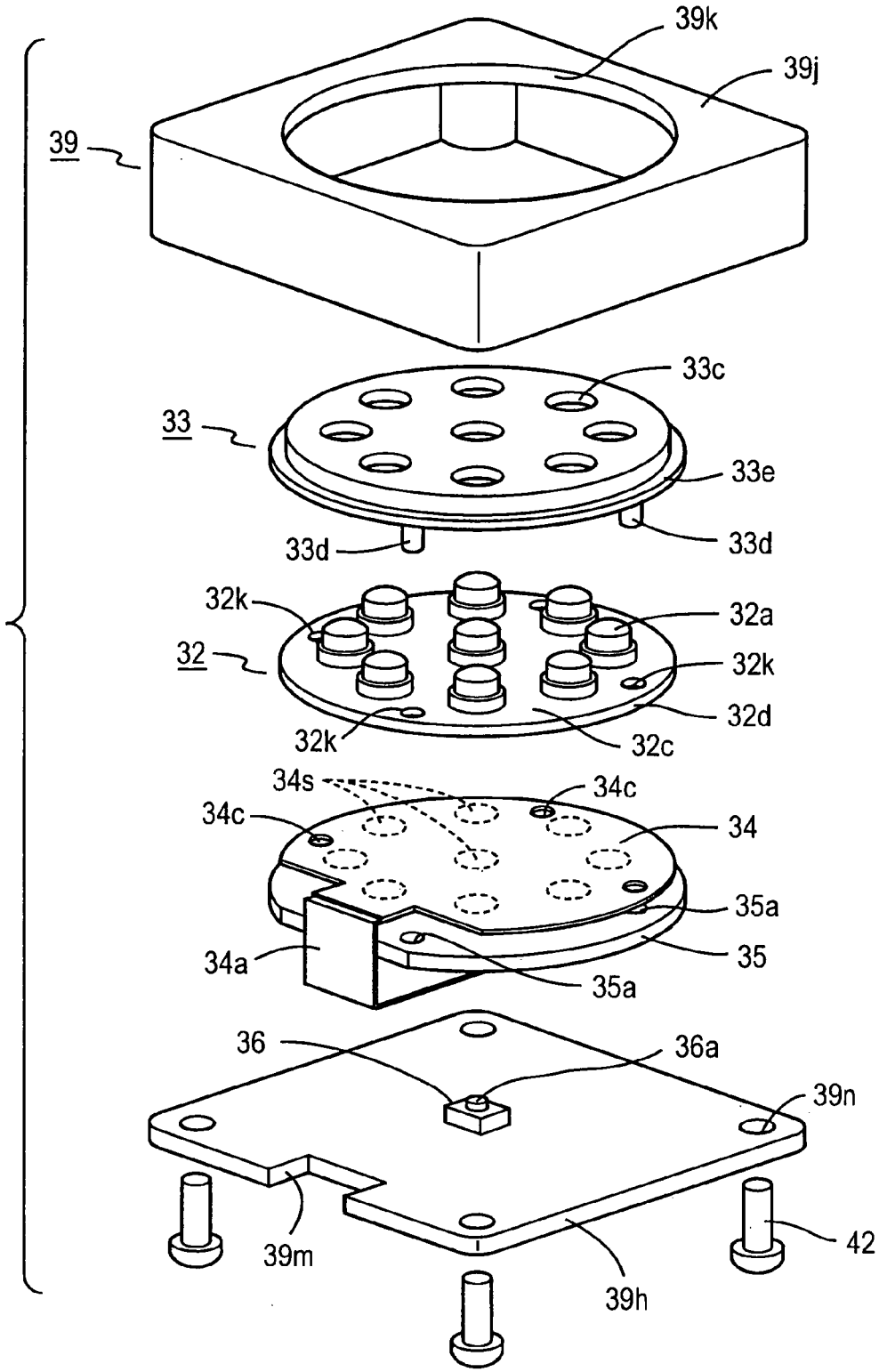
FIG. 13 is an exploded perspective view of the third embodiment as viewed from the front.

As a result of abutment of these air gap formations 32*j* against the membrane sheet 34, the small projection 32*b* moves close to or contacts the membrane switch 34*s*. In this example, the reinforcing plate 35 comprises a molding of a hard resin such as ABS resin or polycarbonate. As shown in FIGS. 13 and 14, the key operation base 33 is integrally formed with a plurality of bosses 33*d* as projections on the rear side thereof, and these bosses 33*d* are sequentially passed through openings 32*k* formed in the elastic sheet 32*c*, openings 34*c* formed in the membrane switches 34*s* and openings 35*a* formed in the reinforcing plate 35 in a manner shown in FIG. 15, and their projecting ends are caulked by heat. In other words, heat and pressure are applied to increase the cross section of the bosses, and these portions are engaged with portions of the openings 35*a* which have a greater diameter. In this manner, the key operation base 33, the knob 32, the membrane switches 34*s* and the reinforcing plate 35 are positioned relative to each other and are also secured together.

As shown in FIG. 11, a spacing between the air gap formation on the marginal portion 32*d* of the elastic sheet 32*c* and the closest small projection 32*b* is substantially equal to a spacing between that smaller projection 32*b* and the air gap formation 32*j* which is located on the other side from the marginal portion 32*d* and which is closest thereto. Unification of the key operation base 33, the membrane switches 34*s* and the reinforcing plate 35 by caulking of bosses under heat which take place in the first embodiment mentioned above takes place in the similar manner as unification of the key operation base 33, the knob 32, the membrane switch 34*s* and the reinforcing plate 35 by caulking of bosses under heat in the third embodiment.

In the present example, a tact switch is used for the second step switch 36. The tact switch 36 includes an internal resilient member which is reversed in configuration when an actuator 36*a* is depressed into a switch case 36*b* by an external force to assume a switch-on condition. The reversal of the resilient member provides a tactile impression (clicking sensation) of a switch operation. When the actuator 36*a* is released from the external force, the resilient restoring force restores the configuration of the resilient member, thus resuming a switch-off position. The tact switch 36 is disclosed, for example, in Japanese Utility Model Registration No. 2,557,784 (issued Dec. 17, 1997).

Figure 15:
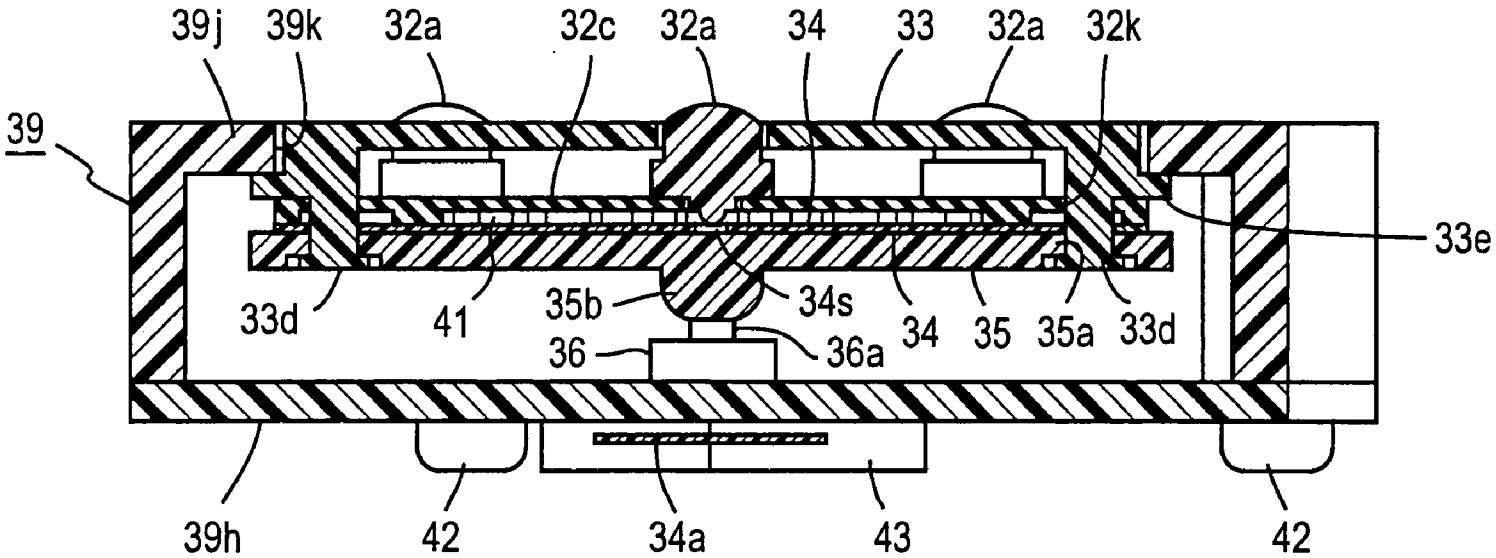
FIG. 15 is a cross section taken along the line XV—XV shown in FIG. 12 for the third embodiment.

The tact switch 36 is secured centrally on the internal surface of the case rear plate 39*h*, for example, at a predetermined position which is previously marked when the rear plate 39*h* is formed. As shown in FIGS. 11, 15 and 16, the projecting end face of the actuator 36*a* of the tact switch 36 is abutted by the reinforcing plate 35, which is an integrally formed projection 35*b* in the present example. The resilient restoring force of the resilient member contained in the tact switch 36 acts through the actuator 36*a* to push back the reinforcing plate 35 toward the surface plate 39*j* of the case 39 until a flange 33*e* disposed around the outer periphery of the key operation base 33 abuts against the internal surface of the surface plate 39*j*. The peripheral edge of the disk-shaped key operation base 33 is folded toward the rear side to extend through a small distance, and the flange 33*e* is integrally formed around the outer periphery of such extension 33*f*.

In the present example, the case 39 is integrally molded with the sidewall of the surface plate 39*j*, as mentioned previously, allowing the rear plate 39*h* to be detachable. As shown in FIGS. 11, 13 and 14, a notch 39*m* is formed in one side of the rear plate 39*h*, allowing the membrane sheet tail 34*a* to be led out. After the key operation base 33, the knob 32, the membrane switches 34*s* and the reinforcing plate 35 are unified in a manner mentioned previously, these are inserted into the case 39 from the rear side, the rear plate 39*h* is brought into abutment against the end face of the sidewall of the case 39 as illustrated in FIG. 11, screws 42 are inserted into openings 39*n* formed in the rear plate 39*h* as shown in FIGS. 13, 14 and 16, and when the screws 42 are clamped into bores 39*p* which are formed in the case sidewall, the rear plate 39*h* is unified with the case.

A printed circuit board is used for the rear plate 39*h*. A position marker (not shown) which is applied when forming the printed circuit may be utilized when mounting the tact switch 36 with a face bond. As shown in FIG. 11, the tail 34*a* of the membrane sheet is taken out through the notch 39*m* and is connected to a connector 43 which is mounted on the outer surface of the rear plate 39*h*. While the connector 43 has not been shown in the first and the second embodiment, it is a general practice that the tail 34*a* of the membrane sheet is connected to a connector which is mounted on the outer surface of the case 39, as illustrated in FIG. 11.

Figure 17A:
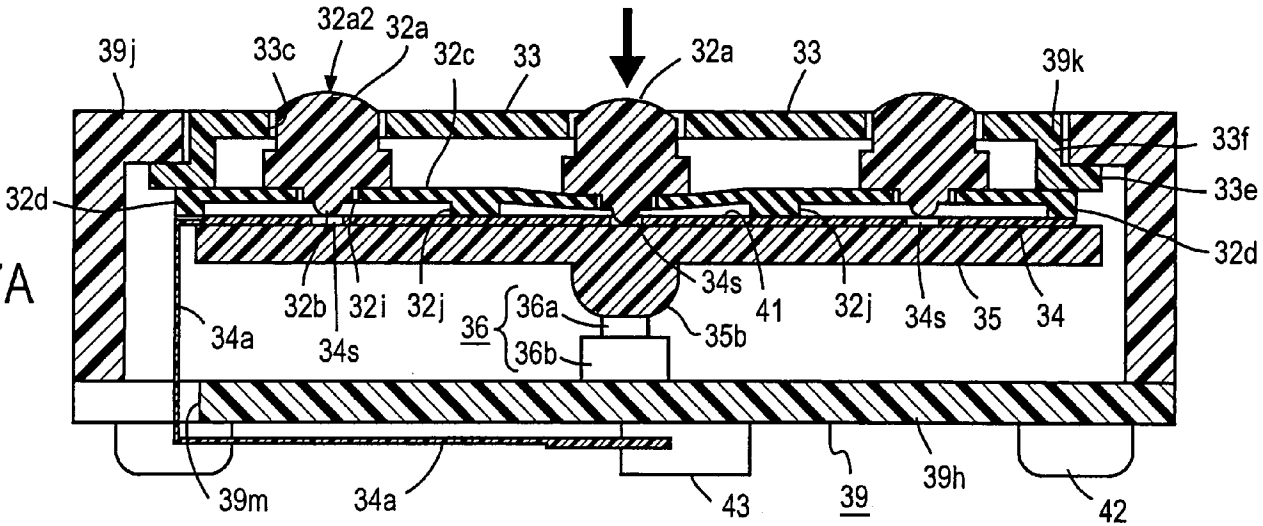

In the third embodiment, when one of the depressing pieces 32*a* is depressed into the case 39, a portion of the elastic sheet 32*c* which lies between that depressing piece 32*a* and the air gap formation 32*j* which is close thereto undergoes an elastic deformation (becomes flexed) initially, as shown in FIG. 17A, and a corresponding one of the first step membrane switches 34*s* is depressed to be turned on. The on-load which occurs at this time can be reduced to a very low level in the similar manner as in the first mode of carrying out the invention, because such load accrues from only the reactions of the elastic sheet 32*c* which has an extremely high pliability and the membrane switch 34*s*.

Figure 17B:
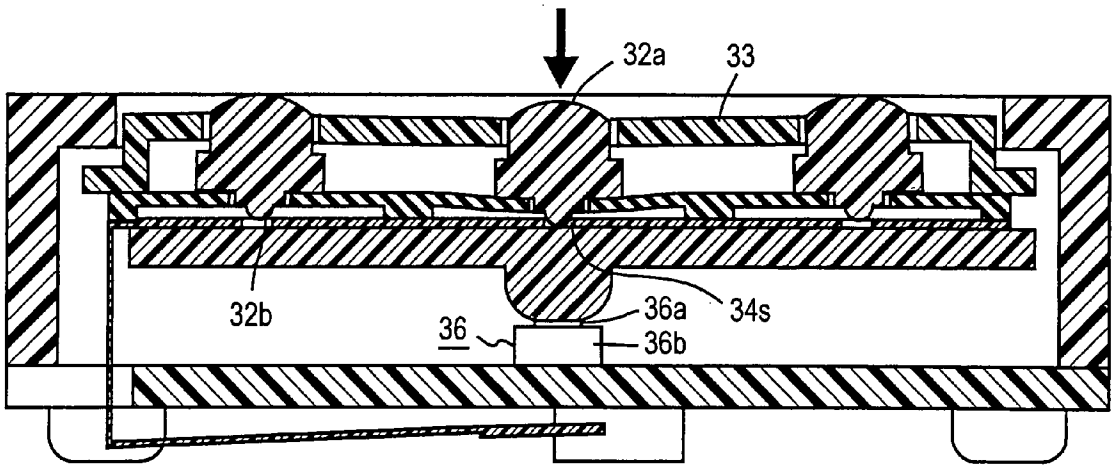

When the depressing piece 32*a* continues to be depressed into the case 39, the reinforcing plate 35 moves toward the rear plate 39*h* against the reaction from the actuator 36*a* of the tact switch 36, as shown in FIG. 17B, whereby the actuator 36*a* is driven into the switch case 36*b* to turn the second step switch 36 on with a clicking sensation. When the depressing piece 32*a* is released from the depression, the resilient restoring force of the resilient member within the tact switch 36 causes the reinforcing plate 35 to move toward the surface plate 39*j*, turning the second step switch 36 off, and the membrane switch 34*s* or the first step switch which has been turned on is turned off again by the restoring force of the elastic sheet 32*c*.

In the second mode of carrying out the invention, the marginal portion 32*d* of the elastic sheet may be carried by the reinforcing plate 35 as by being adhesively bonded thereto, for example.

Third Mode of Carrying Out the Invention

In the third mode of carrying out the invention, the elastic sheet itself represents the surface of the case or the key operation surface, and the marginal portion of the elastic sheet is retained by the case and the key operation base. As illustrated by a section corresponding to FIG. 4 in FIG. 18, for example, a knob 32 faces the exterior through an opening 39*k* in a surface plate 39*j*, a key operation base 33 is disposed on the rear side of the knob, and a marginal portion 32*d* of the elastic sheet 32*c* is retained by a marginal portion of the key operation base 33. Disposed on the rear side of the key operation base 33 is a reinforcing plate 35 on which a first step switch 34*s* is disposed, and a second step switch means 36 is interposed between the reinforcing plate 35 and a rear plate 39*h*. In other words, as compared with FIG. 11, the knob 32 and the key operation base 33 are interchanged in position. A specific example of the third mode of carrying out the invention will now be described in terms of a fourth embodiment.

Fourth Embodiment

Figure 18:
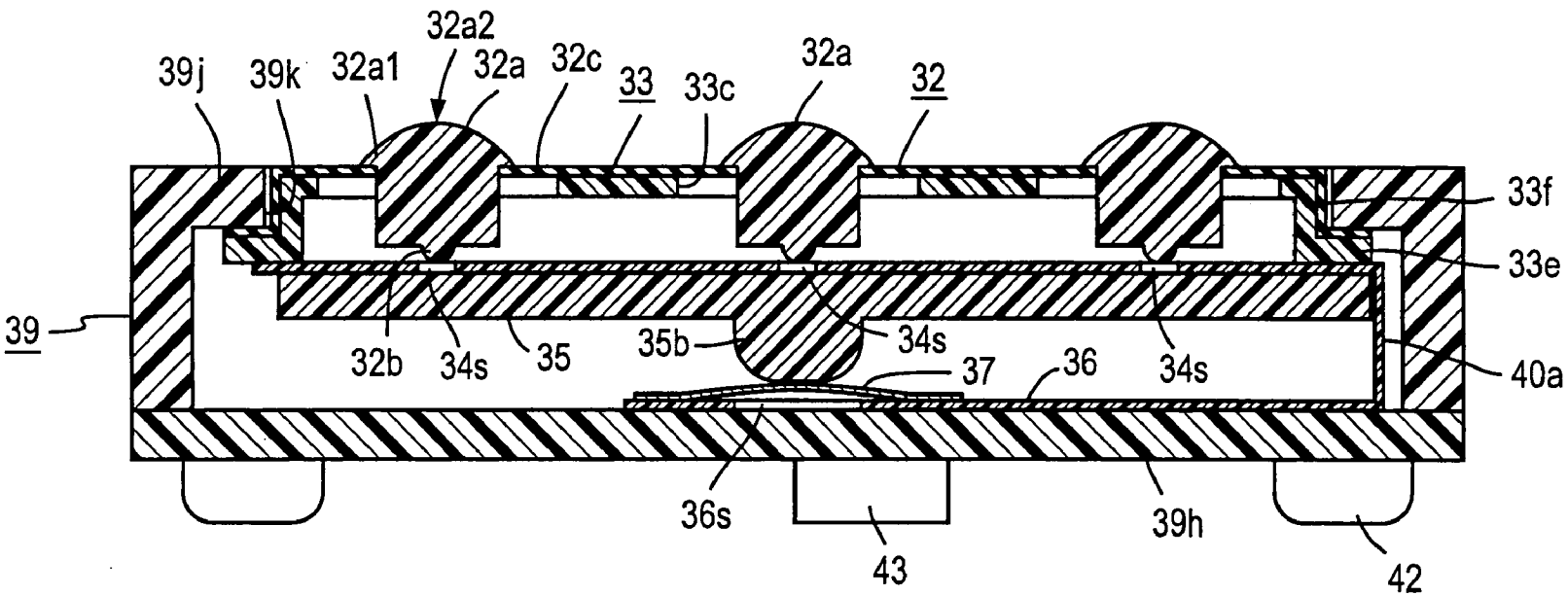
FIG. 18 is a cross section corresponding to FIG. 11, illustrating a fourth embodiment of the present invention.

A fourth embodiment is shown in FIG. 18. In the fourth embodiment, a key operation base 33 which is configured in substantially the same manner as the key operation base 33 used in the third embodiment is employed, and a knob 32 is disposed in abutment against the front surface of the key operation base 33. The knob 32 which is shown in this example has a depressing piece 32*a* and a small projection 32*b* which are integrally molded from a hard resin in the similar manner as the knob shown in FIG. 10. Each depressing piece 32*a* is passed through a passing opening 32*i* formed in an elastic sheet 32*c* which comprises a thermoplastic elastomer, and a flange 32*a*1 which is formed around the periphery of the surface of the depressing piece 32*a* is adhesively bonded to the elastic sheet 32*c*. A depressed surface 32*a*2 inclusive of the flange 32*a*1 is in the form of part of a spherical surface.

Each depressing piece 32*a* is passed through a depression opening 33*c* in the key operation base 33, and the elastic sheet 32*c*, while being in abutment against the front side of the key operation base 33 without any slack, extends along the outer peripheral surface of an extension 33*f* of the key operation base 33, and further extends along the front side of the flange 33*e* in its marginal portion 32*f*, which is in turn retained by the marginal portion of the key operation base 33 or the flange 33*e* in the present example. By way of example, the knob 32 may be integrally molded with respect to the molded key operation base 33. Alternatively, the marginal portion 32*f* may be adhesively secured to the flange 33*e*.

Each depressing piece 32*a* is passed through the depression opening 33*c* in the key operation base 33. The depression opening 33*c* is a concentric circle centered about the depressing piece 32*a*, and a spacing between an inner peripheral surface of the depression opening 33*c* and the peripheral surface of the depressing piece 32*a* is chosen to be a certain size so that a region of the elastic sheet 32*c* which is disposed therebetween can readily be flexed if the depression applied to the depressing piece 32*a* is very weak, and assumes substantially same value for the spacing. Each small projection 32*b* for each depressing piece 32*a* is in contact with or lies close to the first step switch, which is the membrane switch 34*s* in the present example, in the same manner as in the described embodiments. In other words, the fourth embodiment is distinct from the second embodiment principally in the manner of retaining the elastic sheet 32*c*. It should be understood that the unification of the key operation base 33 and the reinforcing plate 35 takes place in the similar manner as in the third embodiment.

In the present example, the membrane switch 36*s* is used for the second step switch means 36, and this is mounted on the internal surface of the rear plate 39*h*. Specifically, the membrane switch 34*s* which serves as the first step switch is extended to form the membrane sheet 40 inclusive of the second step switch 36*s*, in the similar manner as in the first embodiment, but in the fourth embodiment, the connector 40*a* is not directly folded on the rear side of the reinforcing plate 35, but is folded on the internal surface of the rear plate 30*h* and is extended along the internal surface. The membrane switch 36*s* disposed within the extended membrane sheet 40 is positioned so as to be opposite to the center of the reinforcing plate 35. A click plate 37 is interposed between this portion for the membrane switch 36*s* and a projection 35*b* on the reinforcing plate 35. The click plate 37 is in contact with the projecting end face of the projection 35*b* at the center of the convex side thereof.

It will be readily seen that in the fourth embodiment, as the depressing piece 32*a* is depressed, the membrane switch 34*s* which serves as a corresponding first step switch can be turned on with a very weak force as in the second embodiment. When the depression is continued after the first step switch 34*s* has been turned on, the knob 32, the key operation base 33 and the reinforcing plate 35 move toward the rear plate 39*h* in an integral manner, whereby the projection 35*b* causes an elastic deformation of the click plate 37, the reversal of which turns the membrane switch 36*s* which serves as the second step switch on.

If the depressing piece 32*a* is now released from depression, the resilient restoring force of the click plate 37 urges the reinforcing plate 35 toward the surface plate 39*j*, thus turning the membrane switch 36*s* off and also turning the membrane switch 34*s* off.

It is desirable in the third embodiment that a clearance between the peripheral surface of the depressing piece 32*a* and the inner peripheral surface of the depression opening 33*c* be chosen to be narrow in order to prevent the ingress of dust, and in consideration of the maneuverability when moving the finger to select a depressing piece and a good appearance. However, in order for the first step switch 34*s* to be able to respond to a weak depression to be turned on, it is necessary that the depressing piece 32*a* is displaced without interference with the depression opening 33*c* if the depressing piece is depressed with a very weak force. In this respect, a reduction in the clearance between the peripheral surface of the depressing piece 32*a* and the inner peripheral surface of the depressing opening 33*c* is limited in view of the dimensional accuracy and the cost required.

However, in the fourth embodiment, the spacing between the peripheral surface of the depressing piece 32*a* and the inner peripheral surface of the depression opening 33*c* becomes relatively large because of the necessity to make the on-load of the first step switch 34*s* as small as possible, and accordingly, it is possible to turn the first step switch 34*s* on reliably in response to a weak depression force without causing a problem of interference or contacting each other therebetween. In addition, the key operation surface is covered by the knobs 32 without leaving any clearance, thus precluding the likelihood of the ingress of dust and providing a good touch when selecting the depressing piece 32*a* by tangibly feeling it with a finger and also providing a good appearance.

In the third mode of carrying out the invention, rather than extending the marginal portion 32*d* of the elastic sheet 32*c* to the internal surface of the case surface plate 39*j*, it may be molded on or adhesively secured to the extension 33*f* of the key operation base 33.

Modifications

Knob

In the first embodiment, the depressing piece 32*a* and the small projection 32*b* of the knob 32 may be formed with a hard resin in the similar manner as the knob 32 shown in FIG. 10, while the remainder may be formed of a thermoplastic elastomer. Altematively, as shown in FIG. 19A, a portion 32*a*3 of the depressing piece 32*a* which projects from the surface of the elastic sheet 32*c* may be formed with a hard resin while a remainder thereof 32*a*4 and the small projection 32*b* may be formed of a thermoplastic elastomer in an integral manner with the elastic sheet 32*c*.

Figure 19A:
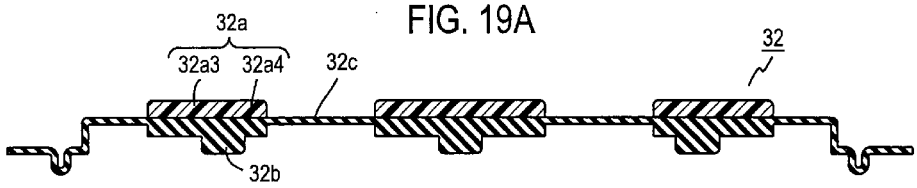
FIG. 19A is a cross section of a modification of a knob 32 shown in FIG. 4.

Also in the second embodiment, the knob 32 may be entirely formed of a thermoplastic elastomer in the similar manner as the knob 32 shown in FIG. 4, or may be constructed in the manner shown in FIG. 19A.

Figure 19B:
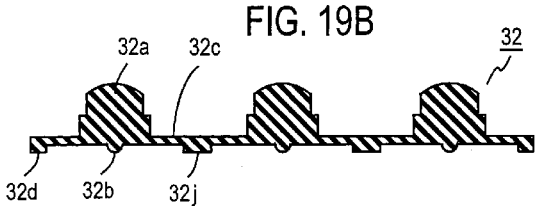
FIG. 19B is a cross section of a modification of a knob 32 shown in FIG. 11.
Figure 19C:
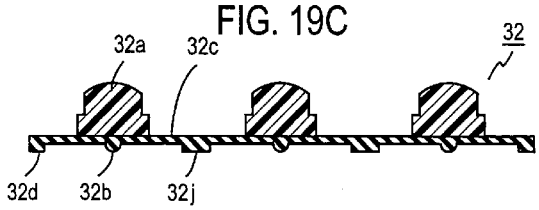
FIG. 19C is a cross section showing another modification of a knob 32 shown in FIG. 11.

In the third embodiment, the depressing piece 32*a*, the small projection 32*b*, the elastic sheet 32*c* and the air gap formation 32*j* of the knob 32 may be entirely formed by an integral molding from a thermoplastic elastomer, as shown in FIG. 19B. Alternatively, the small projection 32*b*, the elastic sheet 32*c* and the air gap formation 32*j* may be formed by an integral molding from a thermoplastic elastomer while the depressing piece 32*a* may be molded from a hard resin and unified with the former by adhesion or by a molding operation, as shown in FIG. 19C.

Figure 19D:
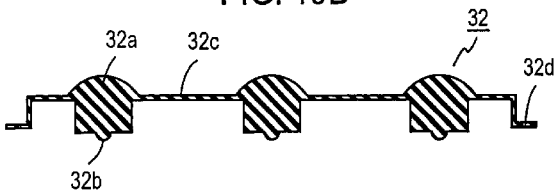
FIG. 19D is a cross section of a modification of a knob 32 shown in FIG. 18.
Figure 19E:
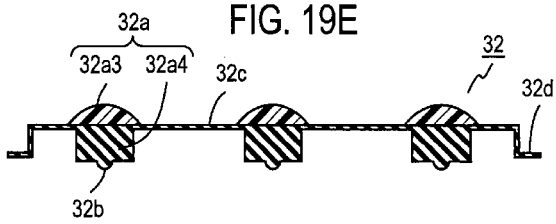
FIG. 19E is a cross section of another modification of a knob 32 shown in FIG. 18.

In the fourth embodiment, parts of the knob 32 may be entirely formed of a thermoplastic elastomer as shown in FIG. 19D. Alternatively, the elastic sheet 32*c* and the portion 32*a*3 which is exposed externally may be formed of a thermoplastic elastomer while the remainder 32*a*4 of the depressing piece 32*a* and the small projection 32*b* may be integrally formed with a hard resin, as shown in FIG. 19E.

In each of the first to the fourth embodiment, the thermoplastic elastomer used in the knob 32 may be replaced by silicone rubber. It is also possible to form only the small projection 32*b* with a separate resin material.

First Step Switch

Figure 20A:
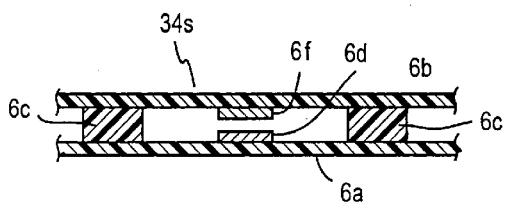
FIG. 20A is a cross section of a modification of the membrane switch 34*s* which serves as the first step switch in the first to the third mode of carrying out the invention.

In each of the first to the fourth embodiment, the membrane switch which serves as the first step switch 34*s* need not be limited to the three contact construction including a pair of fixed contacts and one movable contact as shown in FIG. 3A, but may be constructed by one fixed contact 6*d* and one movable contact 6*f* disposed opposite to each other as shown in section in FIG. 20A, for example. In the arrangement shown in FIG. 3A, lead wires for externally connecting the contacts 6*a* and 6*b* may be formed on the flexible film 6*a* on which the fixed contacts are disposed, but in the construction shown in FIG. 20A, it is necessary to form lead wires for external connection of both the fixed contact 6*b* and the movable contact 6*f* on the flexible films 6*a* and 6*b*, respectively.

Figure 20B:
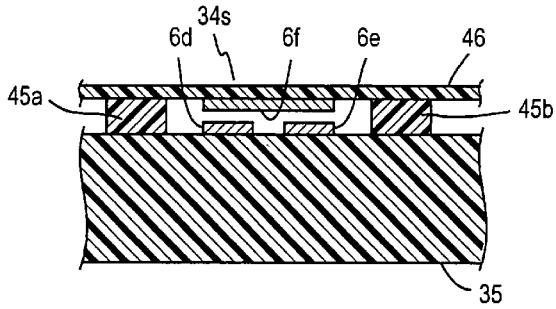
FIG. 20B is a cross section of another modification of the first step switch used in the first to the third mode of carrying out the invention.

An alternative construction as shown in FIG. 20B may be used. Specifically, a reinforcing plate 35 is formed by a printed circuit board and the fixed contacts 6*d* and 6*e* and their lead wires (not shown) may be printed on the front surface while a flexible film 46 such as a polyethylene film or the like is applied on top of the reinforcing plate 35 with spacers 45*a* and 45*b* interposed, and a movable contact 6*f* is printed on the flexible film 46 so as to be located opposite to the fixed contacts 6*d* and 6*e*. This flexible film 46 is depressed by the small projection 32*b* (not shown in FIG. 20B) of the corresponding knob 32 to become flexed, driving the movable contact 6*f* into contact with the fixed contacts 6*d* and 6*e* and to achieve a switch-on condition. When the depression is released, the movable contact 6*f* returns to its original position to resume a switch-off condition. It is to be noted that in this instance, a single fixed contact may be provided as shown in FIG. 20A and the lead wire may be printed on the flexible film 46.

Figure 20C:
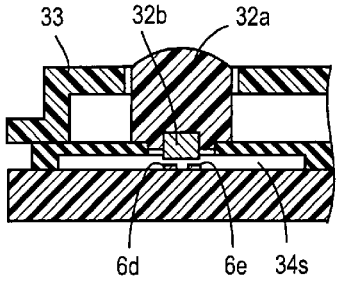
FIG. 20C is a cross section showing an exemplary first step switch in which the small projection 32*b* used in the first to the third mode of carrying out the invention also serves as a movable electrode.

As shown in FIG. 20C, a small projection 32*b* which comprises a conductive rubber or a metal material may be applied as an insert molding to the center of the surface of the depressing piece 32*a* which is opposite from a depressed surface 32*a*2, and the small projection 32*b* may have a planar projecting end face which serves as a movable contact while a pair of fixed contacts 6*e* and 6*d* and their associated lead wires may be printed on the reinforcing plate 35 as shown in FIG. 20B so that the fixed contacts 6*d* and 6*e* are located opposite to the small projection 32*b* acting as a movable contact, thus defining a first step switch 34*s*.

Figure 20D:
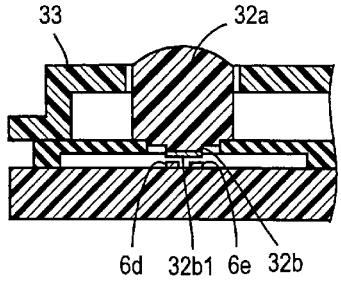
FIG. 20D is a cross section of a modification of a first step switch shown in FIG. 20C.

Alternatively, to serve as a small projection 32*b* which also serves as a movable contact, the small projection 32*b* may be constructed to have a flat projecting end face, to which a conductive painting or a conductive paste may be applied and hardened to form a movable contact 32*b*1 which comprises a conductive layer, as shown in FIG. 20D.

While the first step switch 34*s* is shown alone in FIGS. 20C and 20D, it should be understood that such first step switch 34*s* is provided for each depressing piece 32*a*. While an application to the third embodiment has been illustrated, it may also be applied as each first step switch 34*s* in the first, the second and the fourth embodiment.

In addition, each first step switch 34*s* in the first to the fourth embodiment may comprise a switch similar to a so-called touch panel which can be used as coordinate entry means, information entry means or menu selection means or the like. By way of example, as indicated by an exploded perspective view of FIG. 21A, flexible films 47*a* and 47*b* as may be formed by polyethylene films are closely spaced by a spacer 48 and fixed relative to each other, and a plurality of strip-like electrodes 49*a* and 49*b* are formed so as to be parallel to each other on the opposing internal surfaces of the flexible films 47*a* and 47*b*. As viewed in a direction perpendicular to the flexible film 47*a*, the electrodes 49*a* and 49*b* are orthogonal to each other. While not shown, a small projection 32*b* of each depressing piece 32*a* is disposed in contact with the flexible film 47*a* at each point of intersection.

Thus if some depressing piece 32*a* is depressed, electrodes 49*a* and 49*b* at a corresponding point of intersection contact each other to achieve a switch-on condition, and when the depression is released, the electrodes 49*a* and 49*b* which have been in contact with each other move away from each other to resume a switch-off condition. It is only necessary that the electrodes 49*a* and 49*b* intersect with each other as viewed in a direction perpendicular to the flexible film 47*a* or the key operation surface, and the plurality of electrodes 49*a* and 49*b* need not be parallel to each other, nor it is required that they are straight lines. Since this is not a touch panel which is commonly used, the use of a transparent film or transparent electrode is not required, and because they are not exposed externally, the thickness of each flexible film 47*a*, 47*b* can be reduced as desired. It is pointed out that a touch panel of the kind described is disclosed in Japanese Laid-Open Patent Application No. 61,603/93 (issued Mar. 12, 1993).

A touch panel which uses resistive films is also known and can be used as the first step switch 34*s*. By way of example, as illustrated in FIG. 21B in the form of an exploded perspective view, flexible films 47*a* and 47*b* are closely spaced by a spacer 48 and disposed opposite to each other. Resistive films 51*a* and 51*b* are formed on the opposing surfaces of the flexible films 47*a* and 47*b*. Electrodes 52*a* and 52*b* are formed at one end of one of the resistive films, 51*b*, while electrodes 52*c* and 52*d* are formed at remaining ends. While not shown, small projections 32*b* of a plurality of depressing pieces 32*a* are disposed on the closely spaced resistive films 51*a* and 51*b* in contact with the flexible film 47*a*. The resistive films 51*a* may comprise a conductive film having a small resistance.

When one of the depressing pieces 32*a* is depressed, a corresponding location of the resistive film 51*a* comes into contact with the resistive film 51*b*. A voltage which is developed across the resistive film 51*a* when a voltage is applied across the electrode 52*a* and 52*b* under this condition and a voltage which is developed across the resistive film 51*a* when a voltage is applied across the electrodes 52*c* and 52*d* are measured, and on the basis of these voltage values, a detection is made of which one of the depressing pieces 32*a* has been depressed or whether the first step switch 34*s* which corresponds to that depressing piece 32*a* has been operated and turned on. A touch panel of the kind described is disclosed in Japanese Laid-Open Patent Application No. 189,150/93 (issued Jul. 30, 1993), for example.

Second Step Switch

Figure 22A:
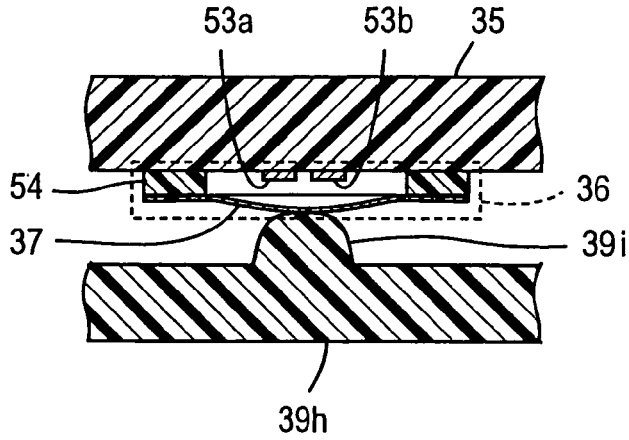
FIG. 22A is a cross section of a modification of the second step switch used in the first to the third mode of carrying out the invention.

Each of the second step switches 36 shown in the first to the fourth embodiment may be constructed as shown in FIG. 22A. A pair of fixed contacts 53*a* and 53*b* and their external connection lead wires (not shown) are formed by printed circuit technology on the surface of the reinforcing plate 35 which is located opposite to the rear plate 39*h*. A click plate 37 is mounted on the reinforcing plate 35 in a manner to oppose the fixed contacts 53*a* and 53*b* with a ring-shaped spacer 54 interposed therebetween. The click plate 37 is convex toward the rear plate 39*h*, and a projection 39*i* is integrally formed on the rear plate 39*h* in contact with the center of the click plate 37. When the reinforcing plate 35 moves toward the rear plate 39*h* in response to the depression of the depressing piece 32*a*, the click plate 37 undergoes an elastic deformation to reverse, whereupon the click plate 37 moves into contact with the both fixed contacts 53*a* and 53*b* to achieve an electrical conduction therebetween, thus turning the second step switch 36*s* on. When the depression is removed, the elastic deformation of the click plate 37 is removed to resume a switch-off condition.

Figure 22B:
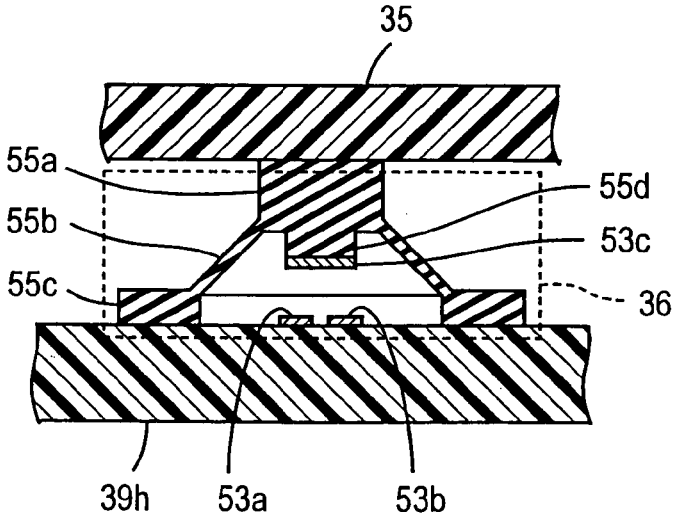
FIG. 22B is cross section of another modification of the second step switch used in the first to the third mode of carrying out the invention.

The second step switch 36 may also be constructed as shown in FIG. 22B. This represents what is referred to as a rubber contact switch which provides a clicking sensation. This switch is dome-shaped and includes a top 55*a*, the top surface of which is disposed in abutment against the rear surface of the reinforcing plate 35 at a central position while the end of the top 55*a* which is located opposite from the top surface is connected around its periphery with a ring-shaped base 55*c* through a skirt 55*b*. A projection 55*d* is formed on the inner surface of the top 55*a*, and a movable contact 53*c* is formed on the projecting end face of the projection 55*d*. The base 55*c* is disposed in abutment against the central portion of the rear plate 39*h*, and fixed contacts 53*a* and 53*b* are formed on the rear plate 39*h* inside the base 55*c* so as to be opposite to the movable contact 53*c*. The top 55*a*, the skirt 55*b*, the base 55*c* and the projection 55*d* are formed as an integral molding of rubber material. The fixed contacts 53*a* and 53*b* and their external connection lead wires (not shown) are printed on the rear plate 39*h*. The top surface of the top 55*a* is secured to the reinforcing plate 35 or the base 55*c* is secured to the rear plate 39*h* as by adhesion.

As the reinforcing plate 35 moves toward the rear plate 39*h* in response to the depression of the depressing piece 32*a*, the skirt 55*b* undergoes an elastic deformation to reverse, whereby the movable contact 53*c* move into contact with the fixed contacts 53*a* and 53*b*, thus turning the switch on. The reversal of the skirt 55*b* provides a clicking sensation. When the depression is released, original configurations are restored due to the resilient restoring force of the skirt 55*b*, thus resuming a switch-off condition.

It should be noted that each second step switch 36 shown in the first to the fourth embodiment may also be used in other embodiments. For example, the second step switch 36 shown in the first embodiment may be used as the second step switch 36 in one of the second to the fourth embodiment.

The second step switch 36 which has self-restoring force and which provides a clicking sensation has been illustrated. However, while the presence of the clicking sensation is desired in the prior art in due of a reliable operation during a normal key entry, it is not essential. Where a second step switch 36 which does not provide a clicking sensation is used, it is desirable that a switch be used which requires a certain stroke before a switch-on condition is reached or a switch which provides a stroking sensation. On the other hand, if the second step switch 36 which provides the clicking sensation is used, a switch with a reduced length of stroking can be used, allowing a thin switch unit to be constructed.

With reference to the second step switch 36 used in the first to the fourth embodiment, if a slight inclination of the knob 32, the key operation base 33 and the reinforcing plate 35 in response to the depression can be allowed, or if an arrangement is made which allows a rotation about a point of contact between the surface plate 39*j* and the flange 33*e* in FIG. 11 such that a point located on the other end is allowed to move toward the rear plate 39*h*, the pusher 35*b* may be omitted if the actuator 36*a* can be directly driven by the reinforcing plate 35 to turn the switch on without any influence of such inclination upon a corner or shoulder of the switch case 36*b* which is disposed on the opposite side from the rear plate 39*h*. Similarly, other corresponding pushers can be omitted.

Fourth Mode of Carrying Out the Invention

Figure 23A:
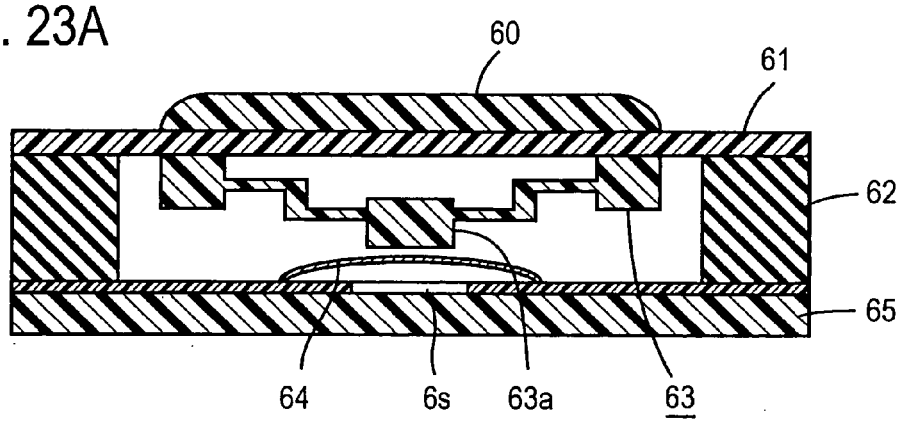
FIG. 23A is a central longitudinal section showing a conventional single step depression responsive switch unit.
Figure 23B:
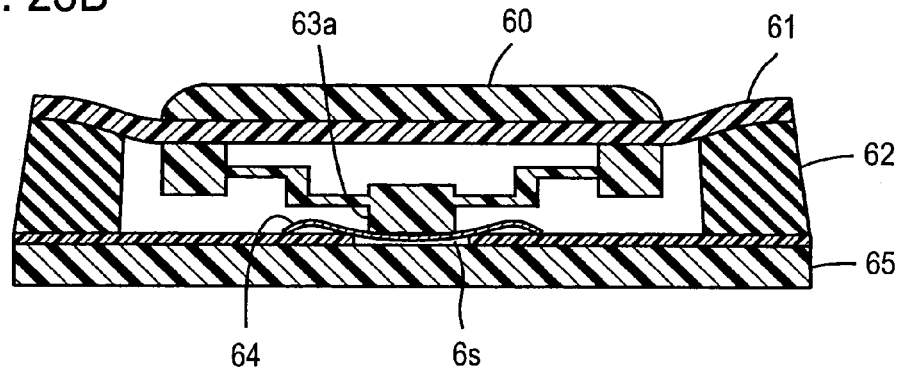
Figure 23C:
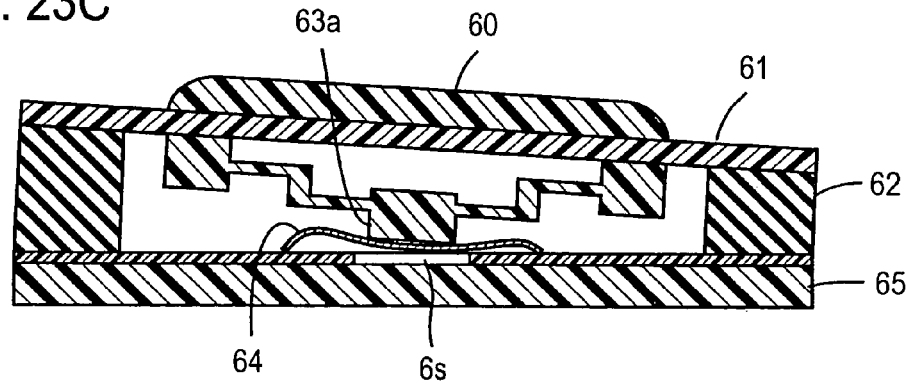
FIG. 23C is a cross section of the switch shown in FIG. 23A when it is edgewise depressed.
Figure 24:
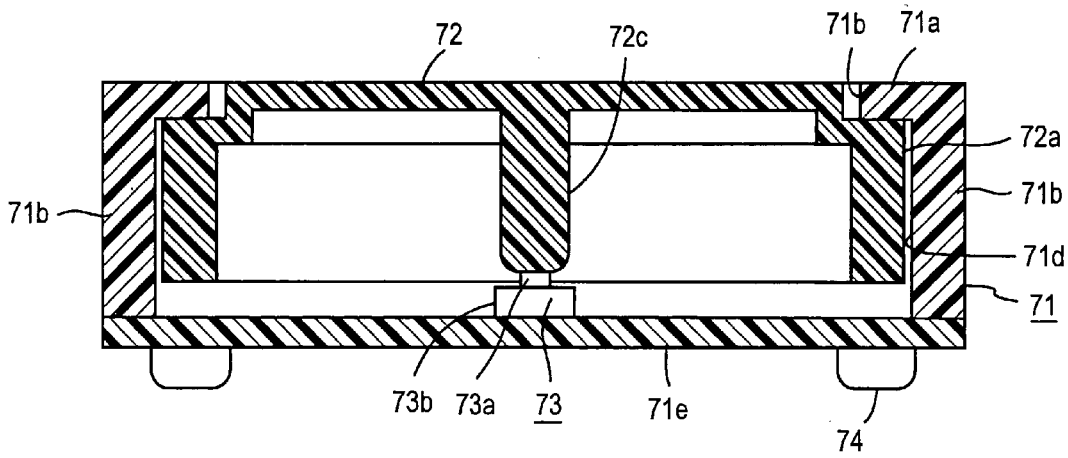
FIG. 24 is a central longitudinal section of another example of a conventional single step depression responsive switch.
Figure 25:
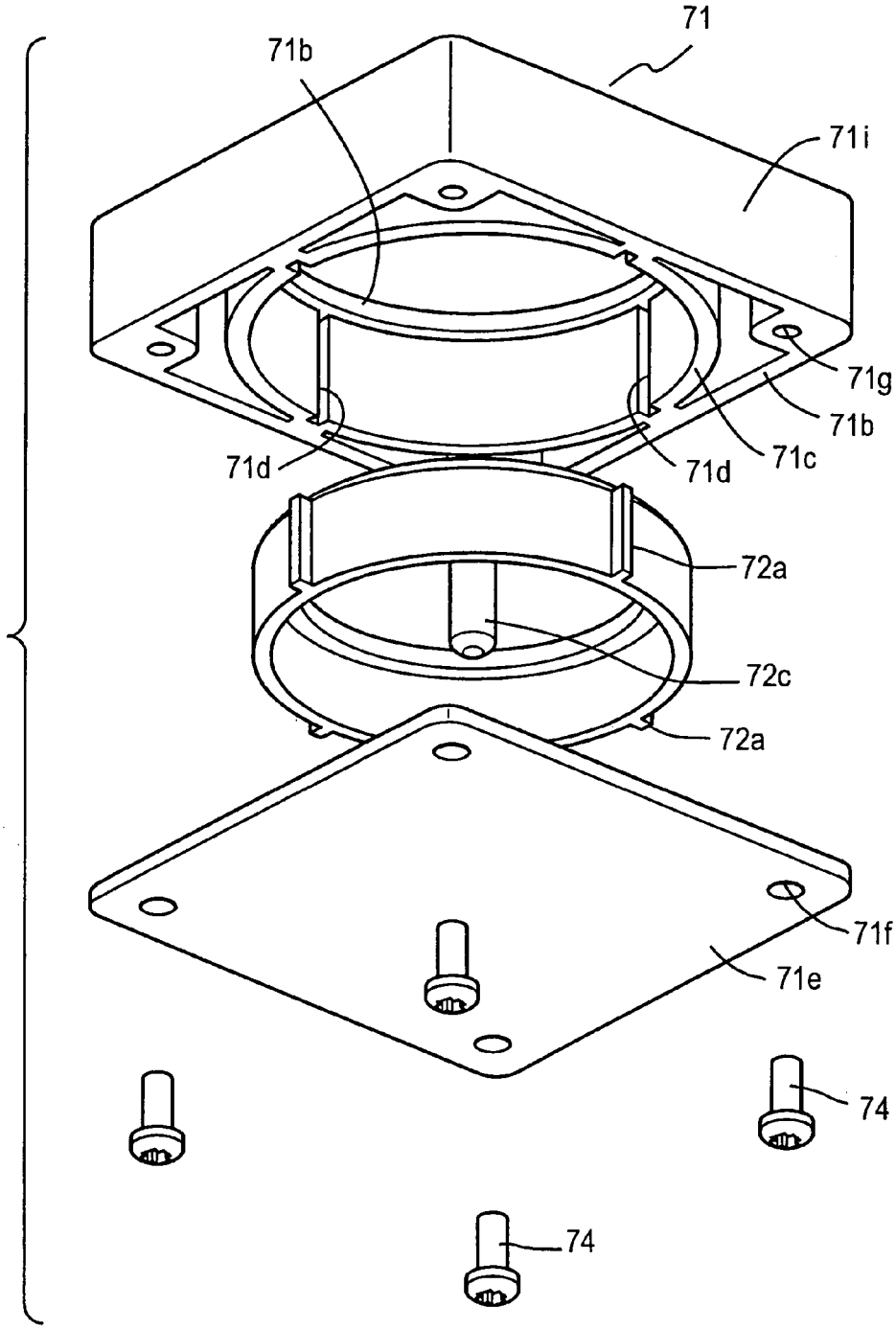
FIG. 25 is an exploded perspective view of the switch unit shown in FIG. 24 as it is viewed from the rear side.

Another mode of carrying out the invention according to a second aspect thereof is directed toward overcoming the problems of a conventional depression responsive switch unit which have been described with reference to FIGS. 23 to 25. This will be described as the fourth mode of carrying out the invention with reference to FIG. 26. A case 71 is constructed as a rigid body, or constructed as a molding of a hard resin such as ABS resin, polycarbonate or the like, for example, and a knob 72 which is formed of a similar hard resin is disposed so as to block an opening 71*b* formed in the surface plate 71*a* of the case 71. The knob 72 is retained by the case 71 by using a thin-walled resilient member 76 such that it is readily deformable in the direction of a normal depression, but is hardly deformable in a direction perpendicular to the direction of a normal depression, or readily displaceable in a direction perpendicular to the rear plate 71, but is hardly displaceable in a direction parallel to the rear plate 71*e*.

The resilient member 76 is formed of a thin-walled metal, fiber, paper, hard resin, elastomer, silicone rubber or the like which is hard to stretch, but is pliable to bend. The resilient member 76 is configured to be symmetrical with respect to the axis of the knob 72. A switch 73 having a self-restoring function is mounted centrally on the internal surface of the rear plate 71. When the knob 72 is depressed, the knob 72 drives the switch 73, turning it on. At this time, if the depression is applied to one point around the edge of the knob 72, the retaining function of the resilient member 76 causes the knob 72 to move in a direction perpendicular to the rear plate 71 e. Accordingly, the switch 73 is always turned on with an even depressing force, allowing a long useful life of a return spring and providing a substantially constant tactile impression and stroking length.

Fifth Embodiment

Figure 26:
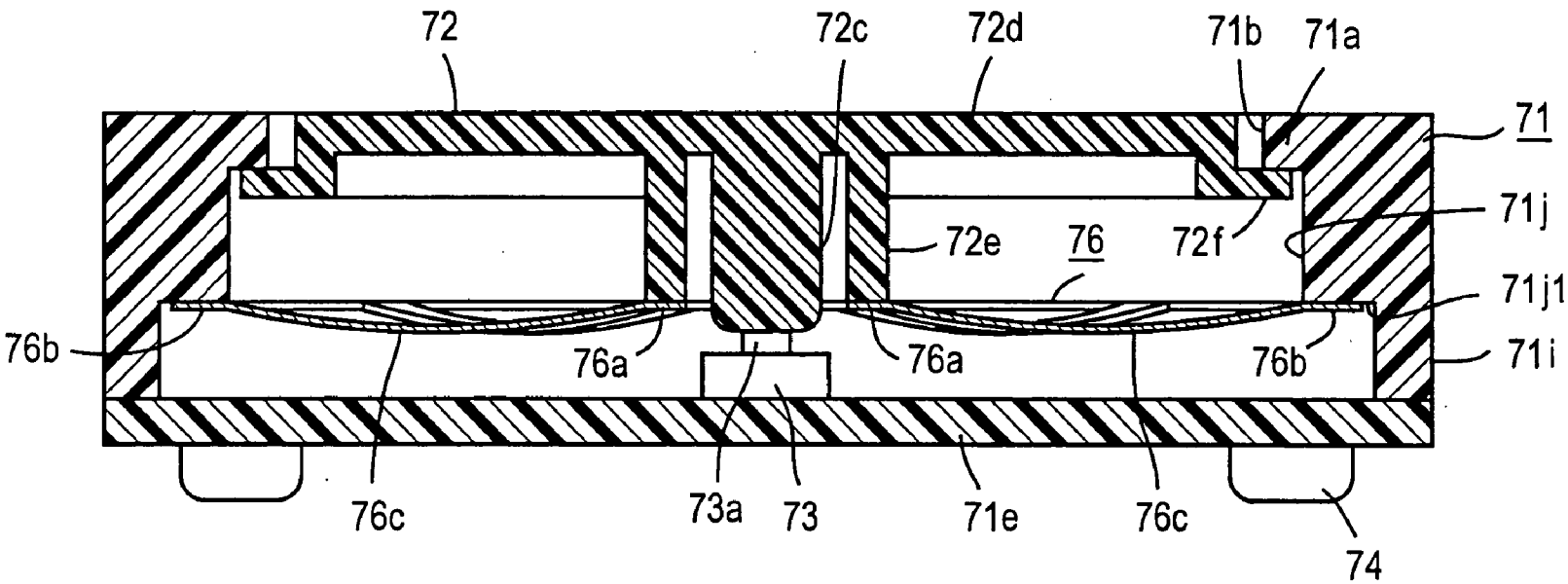
FIG. 26 is a cross section corresponding to FIG. 24, illustrating a fifth embodiment of the present invention.
Figure 27:
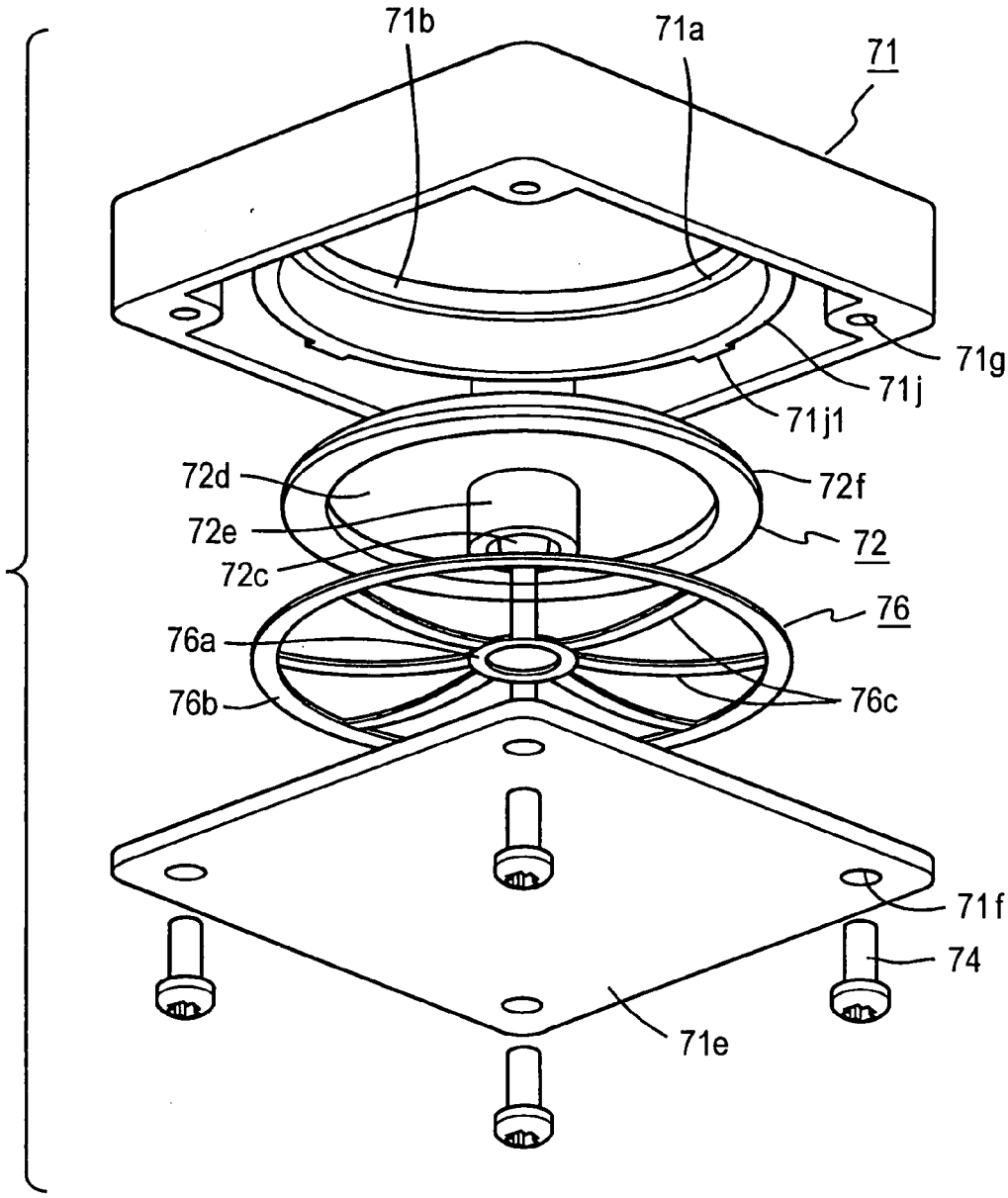
FIG. 27 is an exploded perspective view of the embodiment shown in FIG. 26.

FIGS. 26 and 27 show an embodiment according to the fourth mode of carrying the invention. The case 71 is in the form of a square box, and the opening 71*b* in the surface plate 71*a* is circular and is substantially centered about the axis of the case 71. Screws 74 are inserted into openings 71*f* in the rear plate 71*e*, and are threadably engaged with bores 71*g* formed in the end face of the sidewall 71*i* of the case 71 at the corners thereof, thus securing the rear plate 71*e* to the sidewall 71*i*.

The knob 72 has a circular top plate 72*d* which is positioned so as to substantially block the opening 71*b*. The top plate 72*d* is centrally formed with a projection 72*c* on its internal surface. For connection with the resilient member 76, a tubular portion 72*e* which is centered about the projection 72*c* is integrally formed with the internal surface of the top plate 72*d*. The tubular portion 72*e* has a length which is slightly less than the projection 72*c*. In addition, the top plate 72*d* is integrally formed with a flange 72*f* which has a step in a direction in which the projection 72*c* projects.

A member connector 71*j* is formed on the internal surface of the case sidewall 71*i*, and has a connection surface 71*j*1 located toward the rear plate 71*e* which is substantially coplanar with the end face of the tubular portion 72*e* when the flange 72*f* abuts against the internal surface of the surface plate 71*a*. As viewed in FIG. 26, the member connector 71*j* is cylindrical about the axis of the opening 71*b*, and is unified with the internal surface of the sidewall 71*i* by contact therewith at four locations around the outer peripheral surface.

The resilient member 76 has a configuration which is symmetrical with respect to the axis of the knob 72 and includes at least three linear portions which extend radially at an equi-angular interval from the tubular portion 72*e* to the member connector 71*i* to connect the case 71 and the knob 72 together. Specifically, it comprises a ring-shaped movable connector 76*a*, a ring-shaped case connector 76*b* having a greater diameter, and a body 76*c* including linear portions which connect between the both connectors 76*a* and 76*b*. In the present example, the body 76*c* includes at least three linear portions, although sixth linear portions are shown in FIG. 7, in the form of ribbons which are disposed at an equi-angular interval. These ribbons of the body 76*c* are slightly curved to be convex toward the rear plate 71*e*. The connectors 76*a* and 76*b* and the body 76*c* are integrally formed by a resilient material such as thin metal sheet or hard resin.

The knob connector 76*a* is secured to the end face of the tubular portion 72*e* of the knob 72 as by adhesion while the case connector 76*b* is secured to the connection surface 71*j*1 of the member connector of the case 71 as by adhesion. A tact switch is used as the switch 73. The tact switch 73 is secured to the rear plate 71*e* and has an actuator 73*a*, the projecting end face of which abuts against the end face of the projection 72*c* of the knob, and a reversal spring within the tact switch 73 causes the flange 72*f* of the knob 72 to abut against the internal surface of the surface plate 71*a*.

Figure 28:
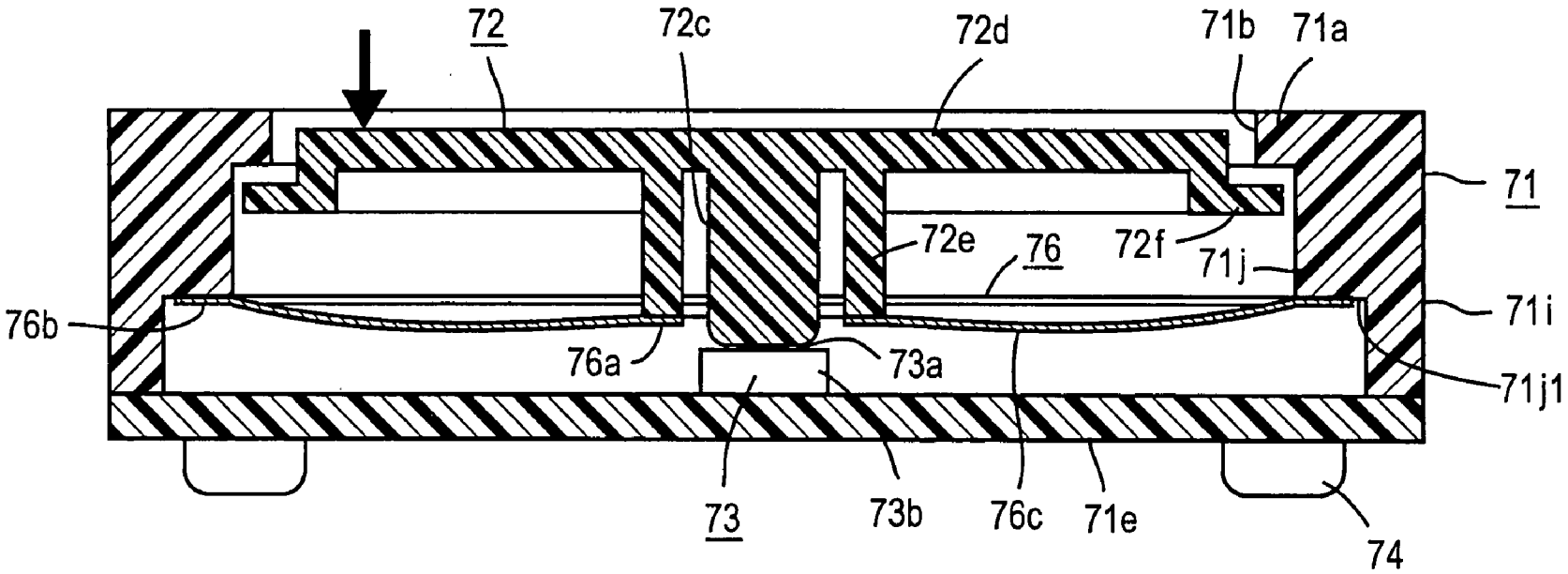
FIG. 28 is a cross section corresponding to FIG. 26, illustrating the fifth embodiment when the knob is edgewise depressed.

With this construction, if the depression is applied to a point around the periphery of the knob 72, as indicated in FIG. 28 by way of example, a component of the depressing force acting upon the knob 72 which is parallel to the rear plate 71*e* is applied to the body 76*c* of the resilient member 76 in its lengthwise direction, whereby the body 76*c* is hardly deformable, thus suppressing the parallel component. However, a component of the depressing force which acts perpendicular to the rear plate 71*e* acts upon the free ends of the ribbon-shaped body 76*c* which are secured to the case 71*e* at their other end, allowing a deformation to occur readily even with a weak force. Thus, the knob 72 is displaced toward the rear plate 71*e* against the reaction from an internal spring within the tact switch 73 and without producing an inclination, whereby the actuator 73*a* is driven into the switch case 73*b*, causing a reversal of the internal spring to turn the tact switch 73 on.

Figure 29:
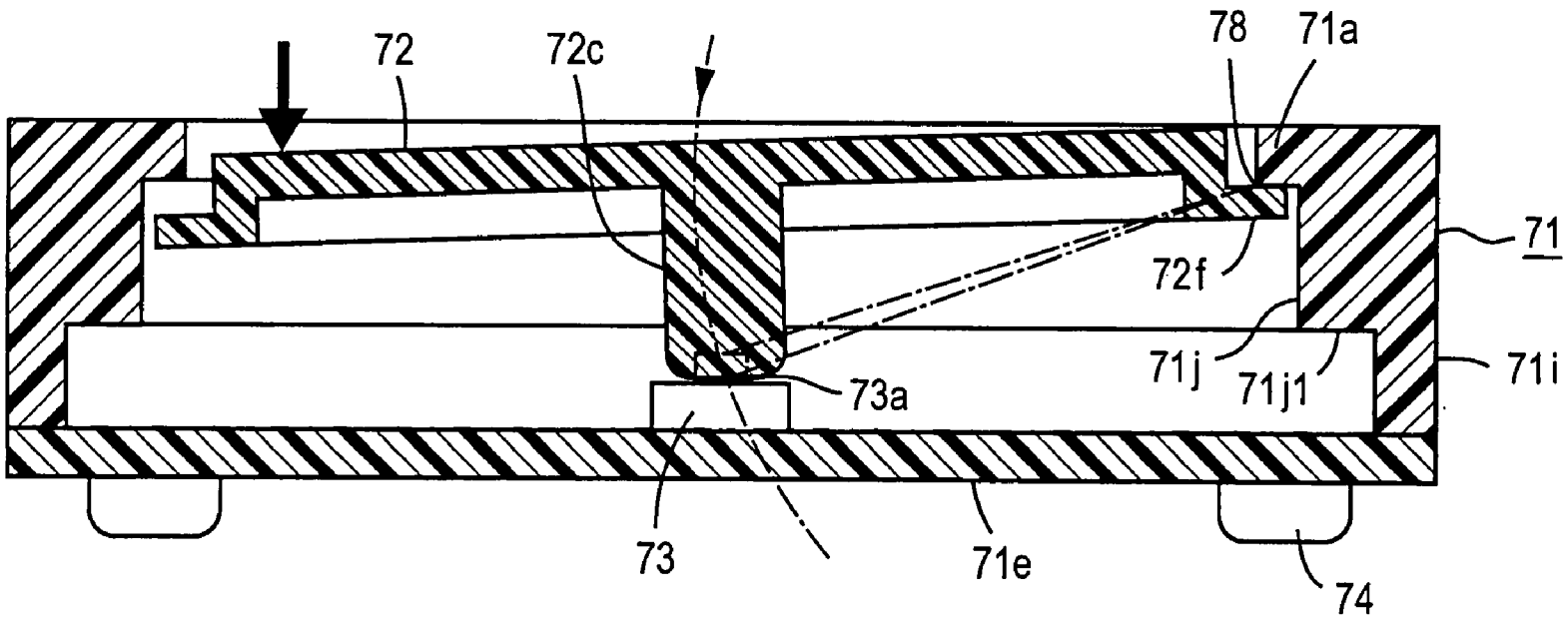
FIG. 29 is a cross section corresponding to FIG. 28 illustrating a result of an edgewise depression where a resilient member 76 shown in FIG. 26 is omitted.

Wherever the knob 72 is depressed, the projection 72*c* urges the actuator 73*a* in a direction perpendicular to the rear plate 71*e*, and accordingly, the tact switch 73 operates reliably even with a weak force with a good clicking sensation and with an even stroking length. A stress which is applied to the reversal spring within the tact switch 73 is maintained relatively low, increasing the useful life of the reversal spring. It should be noted that in an arrangement which lacks the resilient member 76, it will be seen that when a point around the periphery of the knob is depressed, there acts upon the knob 72 a rotating force centered about a point of contact 78 between a region of the flange 72*f* which is located on the opposite side of the projection 72*c* from the depressed point and the surface plate 71*a*, as shown in FIG. 29, whereby a force in a direction parallel to the rear plate 71*e* is applied to the actuator 73*a*, giving rise to a problem which is similar to that experienced in the prior art as described above with reference to FIG. 23. However, in the fifth embodiment, a component of the depressing force which is parallel to the rear plate 71*e* is suppressed by the resilient member 76, and accordingly, the knob 72 is readily displaced in a direction toward the rear plate 71*e* while maintaining its parallel relationship with respect to the rear plate 71*e*.

As will be apparent from the description of the action of the fifth embodiment, the body 76*c* should preferably be as parallel to the rear plate 71*e* as possible from the standpoint of making the body 76*c* less susceptible to a force acting lengthwise thereof and in a direction parallel to the rear plate 71 to curve (or to deform). However, it is preferred that the knob connector 76*a* is readily displaceable with a weak force in a direction perpendicular to the rear plate 71*e*. Consequently, it is desirable to have a curvature of the body 76*c* relative to the rear plate 71*e* which allows the switch 73 to be reliably turned on and which is gentle enough to avoid tensioning the body 76*c*. In addition, from the standpoint of making the knob 72 to be readily displaceable in a direction toward the rear plate 71*e*, it is preferred that a connection be made between a portion of the knob 72 which is located toward the center and a portion of the case 71 which is located toward the sidewall in order to increase the length of the linear body 76*c*.

Sixth Embodiment

Figure 30:
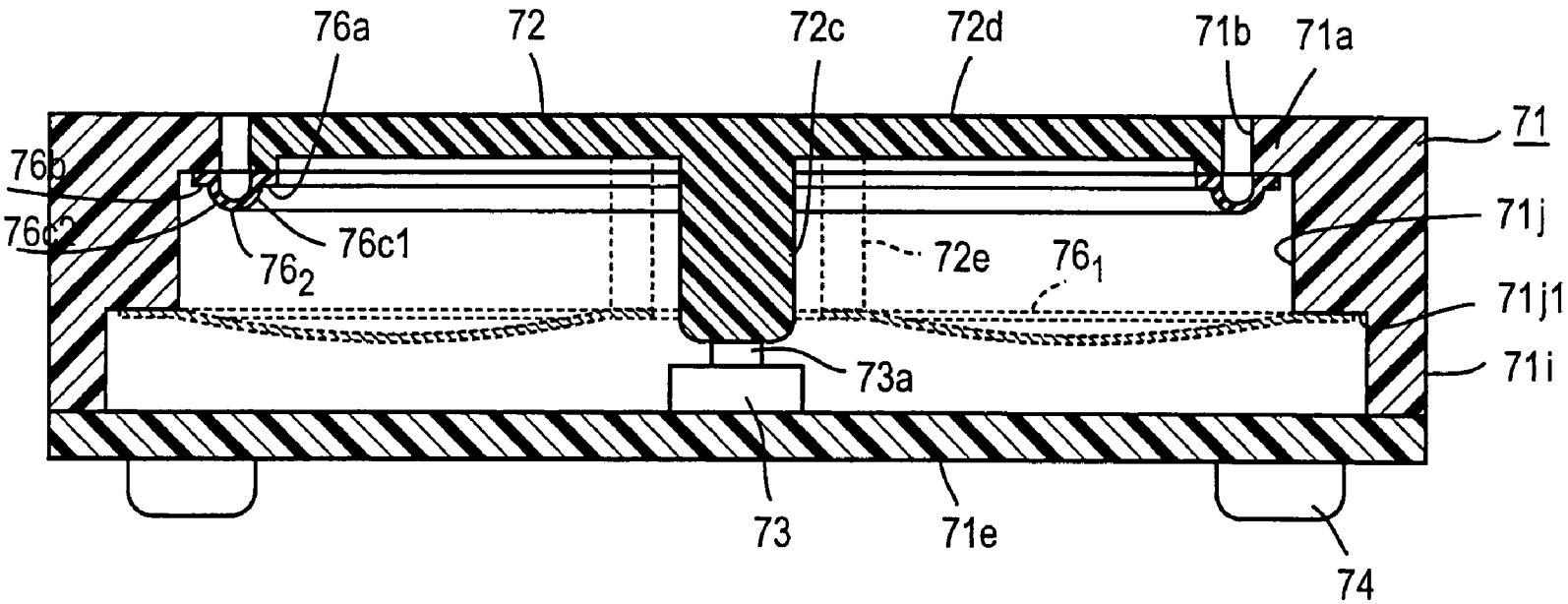
FIG. 30 is a cross section corresponding to FIG. 26, illustrating a sixth embodiment of the invention.

FIG. 30 shows a sixth embodiment as another example of the fourth mode of carrying out the invention. In this example, a ring-shaped resilient member 76 which is U-shaped in section has its outer periphery and inner periphery secured to the periphery of the opening 71*b* on the internal surface of the surface plate 71*a* of the case 71 and to the periphery of the knob 72 on its internal surface, respectively, as by adhesion. In this instance, the resilient member 76 is constructed such that the body 76*c* extending between connectors 76*b* and 76*a* which are connected to the case 71 and the knob 72, respectively, be formed over the entire perimeter, and the resilient member 76 may be formed of a variety of materials as mentioned previously. However, in particular, a thermoplastic elastomer or a silicone rubber is suitable at this end.

With this construction, when a central portion of the knob 72 is depressed, only a force which is directed perpendicular to the rear plate 71*e* is evenly applied to every portion of the knob connector 76*a* of the ring-shaped resilient member 76, so that the body 76*c* is deformed readily and evenly, allowing the knob 72 to be displaced toward the rear plate 71*e* while maintaining its parallel relationship with respect to the rear plate 71*e*.

If the depression is applied to the knob 72 at a point toward the periphery thereof, a force which causes the knob 72 to be inclined with respect to the rear plate 71*e* or which causes the knob 72 to move in a direction parallel to the rear plate 71*e* will act. However, when a peripheral surface portion 76*c*1 disposed toward the knob connector 76*a* and which is formed as one limb of the U-shaped section and a peripheral surface portion 76*c*2 which is disposed toward the case and which defines the other limb are integrally connected together through an intermediate portion of U-shape, the body 76*c* of the resilient member 76 which is U-shaped in section acts to change the portions 76*c*1 and 76*c*2 relative to each other in a plane which is parallel to the rear surface 71*e*. Accordingly, it would appear that at one of left and right ends as viewed in FIG. 30, the peripheral surface portions 76*c*1 and 76*c*2 move toward each other while they move away from each other at the other end, and therefore, if this aspect is considered alone, it would appear that the knob 72 will be relatively readily displaced to the right, for example. However, when the viewpoint is shifted to the center and considering opposite ends of a line which extends in a direction perpendicular to the plane of the drawing, there acts a force which causes the peripheral surface portions 76*c*1 and 76*c*2 to be offset to the left and to the right, respectively. Because such action must be considered, it will be seen that a greater force will be required to offset the peripheral surface portion 76*c*1 relative to the peripheral surface portion 76*c*2. As a consequence, if the knob 72 is edgewise depressed, the action of the resilient member 76 is effective to cause the knob 72 to move relative to the rear plate 71*e* while maintaining its parallel relationship therewith.

As discussed above, a finctioning and effect similar to that obtained in the fifth embodiment is available in the sixth embodiment. As will be understood from the described functioning and effect, the ring-shaped resilient member 76 which is U-shaped in section is more effective when the both limbs of the U-shape or the both peripheral surface portions 76*c*1 and 76*c*2 are located closely relative to each other, and therefore should be connected to locations which are as close to the casing 71 and the knob 72, respectively, as possible.

The resilient member 76 blocks a space between the surface plate 71*a* and the knob 72, thus providing a dust-proof effect. As indicated in broken lines in FIG. 30, when the resilient member 76 including the linear body 76*c* shown in FIG. 26 is also used in combination, the maneuverability against an edgewise depression is improved.

Modification

Figure 31A:
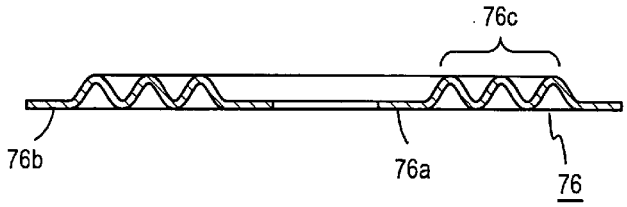
FIG. 31A is a central cross section showing a modification of the resilient member 76 used in the fourth mode.
Figure 31B:
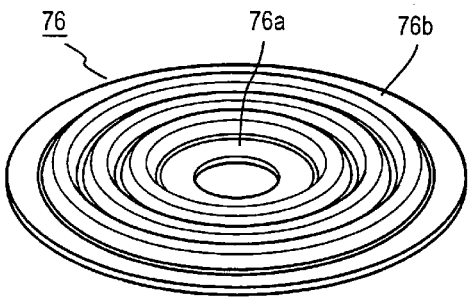
FIG. 31B is a perspective view of the resilient member shown in FIG. 31A.

A resilient member 76 may be constructed as shown in FIGS. 31A and 31B, for example, where a body 76*c* disposed between a knob connector 76*a* and a case connector 76*b* is corrugated in the form of concentric circles with the both connectors 76*a*, 76*b*, thus connecting the both connectors 76*a* and 76*b* over the full perimeter. The material to form such an example should preferably be paper or fiber.

Figure 31C:
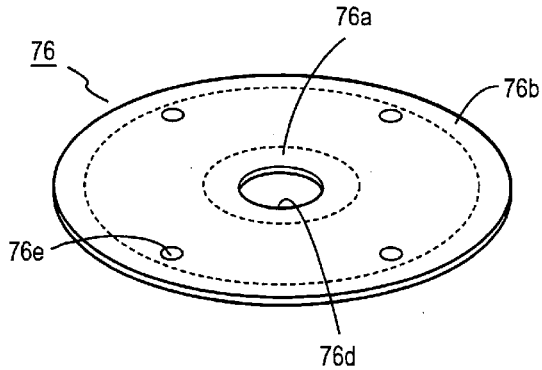
FIG. 31C illustrates another modification of an elastic deformation member 76.

A further example is shown in FIG. 31C where a resilient member 76 comprises a single flat sheet, which is circular in this example. A circular opening 76*d* is formed at the center of the sheet, and the periphery of the circular opening 76*d* defines a knob connector 76*a*, which may be adhesively secured to the end face of the tubular portion 72*e* shown in FIG. 26, for example. Small openings 76*e* are formed in the outer periphery of the resilient member 76 at least three locations or at four locations as shown in FIG. 36C. The periphery of the small opening 76*e* defines the case connector 76*b* to be secured to the case 71. This securing operation may take place in the similar manner as securing the peripheral edge 32*f* shown in FIG. 8, for example. A construction material chosen in this instance should preferably be a thermoplastic elastomer or a silicone rubber. This makes the knob 72 to be readily displaceable in a direction toward the rear plate 7*e*, but hardly displaceable in a direction parallel to the rear plate 71*e*.

The switch 73 is not limited to the tact switch. What is required is that the switch is turned on when the knob 72 is depressed and that when the depression is released, the resilient restoring force of the spring automatically returns the knob 72 to its original condition. The presence of the clicking sensation is not required. The second step switch 36 shown in FIG. 4 or switches shown in FIGS. 22A and 22B may be used.

Fifth Mode of Carrying Out the Invention

The fifth mode of carrying out the invention is applied to a depression responsive two-step switch unit where the knob 72 which operates on the second-step switch 73 is retained by a resilient member 76.

The arrangement which is the same as the first embodiment mentioned above, for example, may be cited as an embodiment for this mode. Specifically, referring to FIGS. 4 to 7, the second step switch 36 corresponds to the switch 73, and the associated knob 72 comprises the knob 32, the key operation base 33, the first step switch 34*s* and the reinforcing plate 35 which are unified. The marginal portion 32*f* is secured to the case 39 at a plurality of points while the remainder remains free, and this corresponds to a modification of the resilient member 76 shown in FIG. 31C. Similarly, the second embodiment mentioned previously with reference to FIG. 10 is also equivalent to an embodiment of the fifth mode of carrying out the invention. The knob 72 remains similar to the first embodiment, the second step switch 73 corresponds to the second step switch 36 shown in FIG. 10, and the resilient member 76 comprises the marginal portion 32*f* which is U-shaped in section, this corresponding to one shown in FIG. 30.

Figure 32:
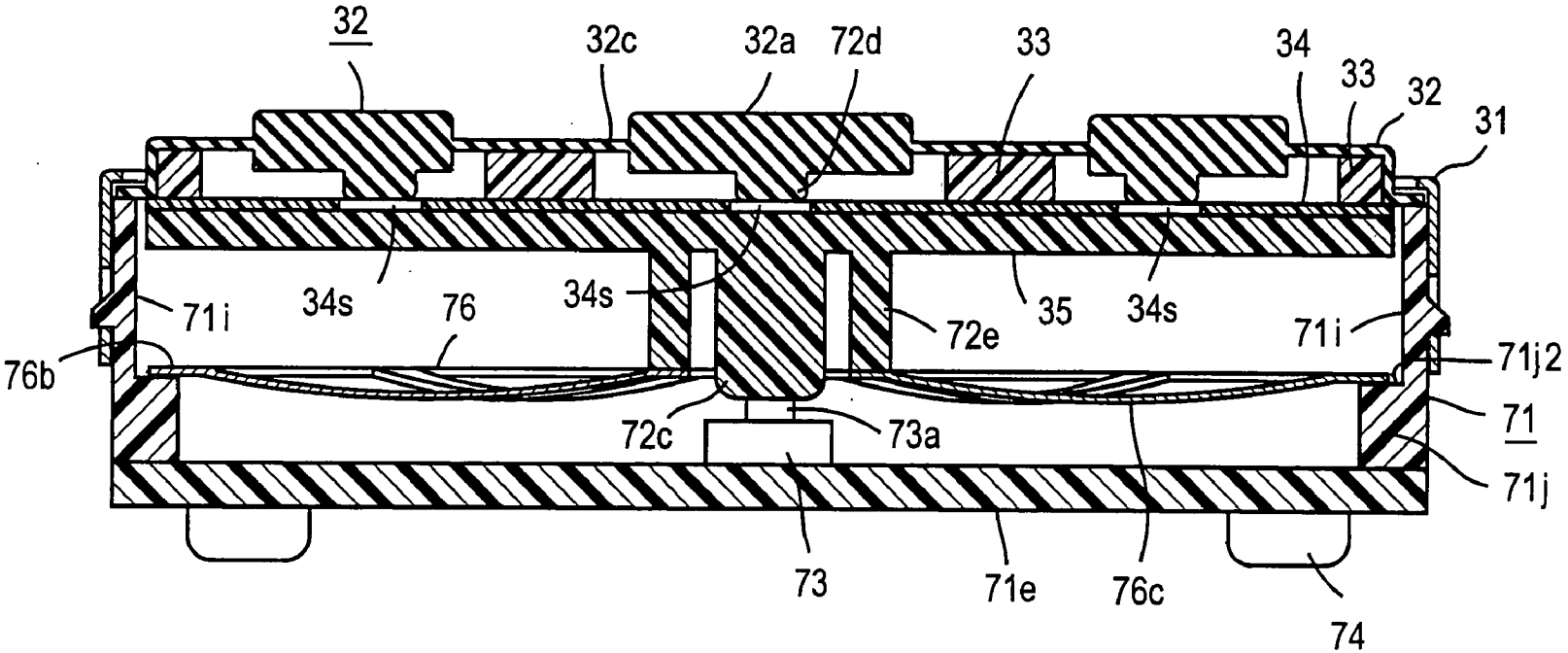
FIG. 32 is a cross section corresponding to FIGS. 4 and 26 and illustrating an embodiment in the fifth mode of carrying out the present invention.

A movable portion including each first step switch 34*s* which is used in the first to the third mode of carrying out the invention or the portion which drives the second step switch 36 is chosen as a knob 72 in another embodiment of the fifth mode of carrying out the invention which uses the resilient member 76 used in the fourth mode of carrying out the invention. Such an embodiment is illustrated by a combination of the first and the fifth embodiment, which is shown in section in FIG. 32 even though a duplicated description is omitted. In FIG. 32, a member connector 71*j* is formed on the internal surface of the sidewall 71*i* at a location toward the rear plate 71*e*, and has a connecting surface 71*j*2 toward the cover (surface plate) 31, to which the case connector 76*b* of the resilient member 76 is secured. Specifically, when combining one of the first to the third mode with the fourth mode of carrying out the invention, the key operation base 33 and the surface plate 39*j* and/or the reinforcing plate 35 or the projection 35*b* thereon and the case sidewalls 39*a*, 39*b* are connected together by the resilient member 76.

Figure 2:
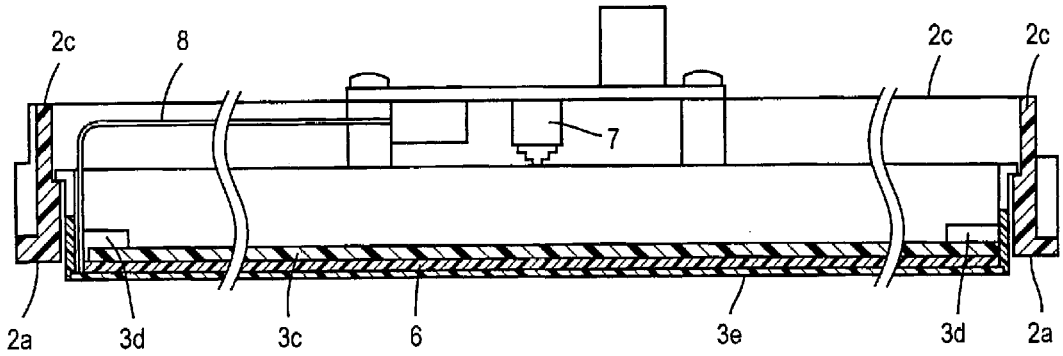
FIG. 2 PRIOR ART
FIG. 2 is a longitudinal section taken along the line II—II shown in FIG. 1.
Figure 21A:
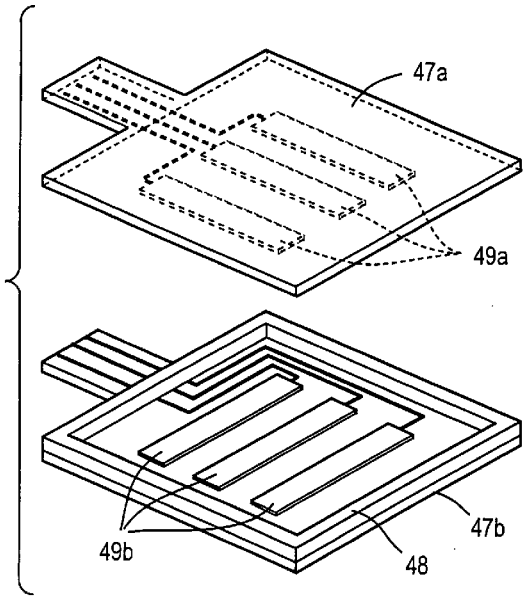
FIG. 21A is an exploded perspective view of a touch panel which serves as the first step switch in the first to the third mode of carrying out the invention.
Figure 21B:
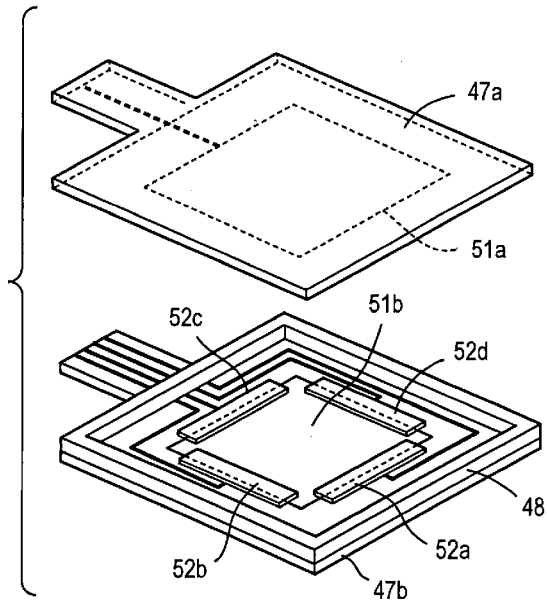
FIG. 21B is a cross section of a modification of the touch panel shown in FIG. 21A.

A first step switch used in the embodiment for the fifth mode of carrying out the invention is not limited to those mentioned above in connection with the first to the third mode of carrying out the invention as well as modifications thereof, but may be a membrane switch which is covered with the surface sheet shown in FIGS. 1 to 3, for example, or may be a touch panel shown in FIG. 21A or 21B which is arranged to be directly depressed from the exterior.

Figure 33:
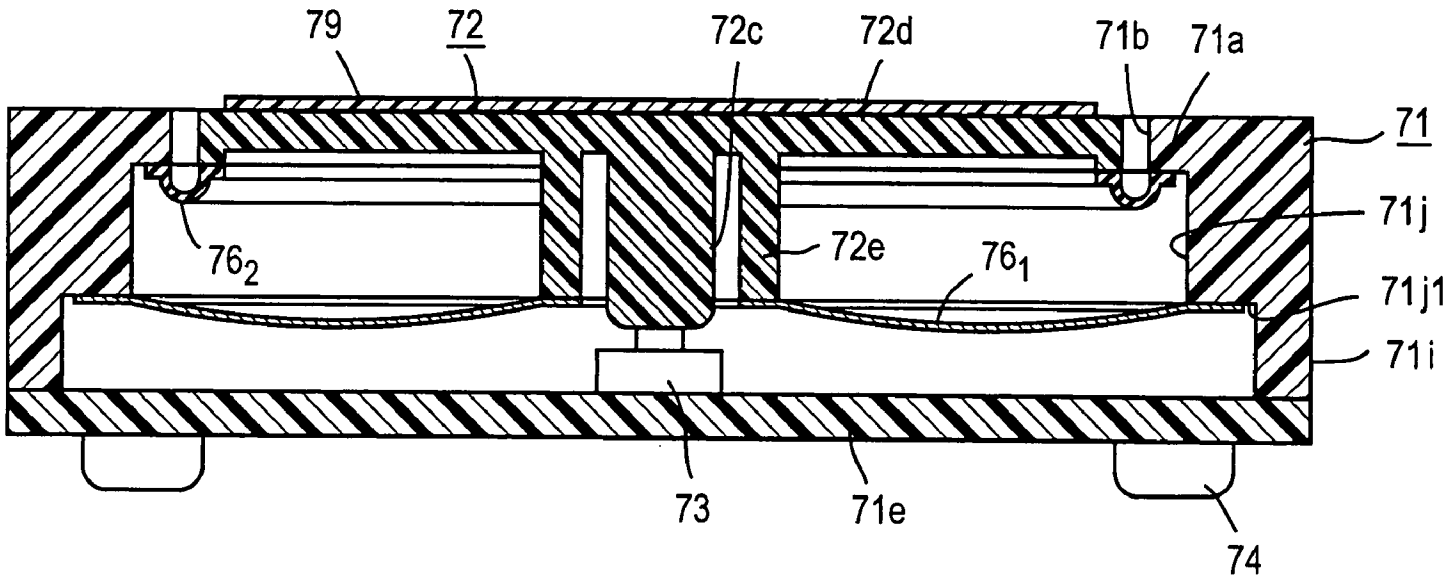
FIG. 33 is a cross section corresponding to FIG. 26, schematically illustrating the embodiment in the fifth mode of carrying out the present invention.

A schematic illustration of what is mentioned above is illustrated in FIG. 33 by way of example. In this example, a knob 72 is retained by a case 71 through a resilient member $\mathbf{76}_1$ having a linear body which is used in the fifth embodiment and a resilient member $\mathbf{76}_2$ having a ring-shaped body which is U-shaped in section and which is used in the sixth embodiment. In other words, a portion of the knob 72 which is located close to the projecting end of the projection 72*c* and another portion thereof which is located close to the internal surface of the top plate 72*d* are retained by the case 71 through different kinds of resilient members $\mathbf{76}_1$ and $\mathbf{76}_2$. Specifically, the knob 72 is retained by the case 71 through two resilient members $\mathbf{76}_1$ and $\mathbf{76}_2$ which are spaced apart in a direction perpendicular to the rear plate 71*e*. A first step switch 79 such as a membrane switch or a touch panel is disposed on the top plate 72*d* of the knob 72. While not shown, whatever the construction of the first step switch 79, a band-shaped flexible cable (FBC) including external connection lead wires for respective switches in the first step switch assembly 79 is taken out from the interior of the case 71, as illustrated by FBC8 in FIGS. 1 to 3, for example.

In the two-step switch unit according to the fifth mode of carrying out the invention, the second step switch 73 may comprise a variety of switches without being limited to the tact switch, in the similar manner as mentioned above.

What is claimed is:

1. A depression responsive switch unit in which a switch is turned on in response to a depression operation; comprising a case including a surface plate in which an opening is formed;

a reinforcing plate disposed opposite to a rear plate of the case and disposed within the case so as to be reciprocable with respect to the rear plate;

a second step switch interposed between the reinforcing plate and the rear plate and adapted to be operated on by a movement of the reinforcing plate toward the rear plate;

a plurality of first step switches disposed on the reinforcing plate on the side located toward the surface plate;

a key operation base disposed on the case in a manner to block the opening in the surface plate and formed with depression openings each located corresponding to each first step switch;

and a knob disposed on the key operation base on the opposite side from the reinforcing plate;

the knob including an elastic sheet which is formed of a thermoplastic elastomer or a silicone rubber and having a marginal portion which is retained by the case, depressing pieces formed on the elastic sheet in a manner corresponding to each first step switch and having a depressed surface on the front side of the elastic sheet and disposed in each depression opening, and a small projection projecting from each depressing piece in the opposite direction from the depressed surface to be located close to or in contact with the first step switch.

2. A depression responsive switch unit according to claim 1, in which the elastic sheet, the depressing pieces and the small projections are integrally formed with a thermoplastic elastomer or silicone rubber.

3. A depression responsive switch unit according to claim 1 in which the elastic sheet is formed with an opening in a manner corresponding to each depressing piece, the depressing piece being passed through a corresponding one of the openings, a depressing piece having a flange which is disposed in abutment against and secured to the elastic sheet, each depressing piece, its flange and corresponding small projection being integrally formed with a hard resin.

4. A depression responsive switch unit according to claim 1 in which each depressing piece comprises an external portion which is exposed externally of the elastic sheet and a remainder, the external portion being formed by a hard resin while the remainder of the depressing piece being integrally formed of a thermoplastic elastomer or silicone rubber together with the elastic sheet and the small projection.

5. A depression responsive switch unit according to claim 1 in which the marginal portion of the elastic sheet is held sandwiched by the case at only a plurality of locations to be secured.

6. A depression responsive switch unit according to claim 1 in which the marginal portion of the elastic sheet is formed with a ring which is U-shaped in section around the full perimeter of the knob at a location inside thereof which is retained by the case.

7. A depression responsive switch unit in which a switch is turned on in response to a depression operation comprising a case including a surface place in which an opening is formed;

a reinforcing plate disposed opposite to a rear plate of the case and disposed within the case so as to be reciprocable relative to the rear plate;

a second step switch interposed between the reinforcing plate and the rear plate and operated on by a movement of the reinforcing plate toward the rear plate;

a plurality of first step switches disposed on the reinforcing plate on the side located toward the surface plate;

a key operation base disposed on the case so as to block the opening in the surface plate and formed with depression openings corresponding to the location of each first step switch;

and a knob disposed between the reinforcing plate and the key operation base;

the knob including an elastic sheet which is formed of a thermoplastic elastomer or a silicone rubber and having a marginal portion which is held sandwiched between the key operation base and the reinforcing plate to be secured, depressing pieces formed on the elastic sheet so as to correspond to each first step switch, each depressing piece being disposed in a depression opening formed in the key operation base, and a small projection projecting from elastic sheet for each depressing piece to be located close to or in contact with the first step switch.

8. A depression responsive switch unit according to claim 7 in which the elastic sheet is formed with a plurality of air gap formations which project toward the reinforcing plate and which are located on the opposite sides of each small projection and spaced therefrom by an equal distance, the air gap formations being in contact with the reinforcing plate.

9. A depression responsive switch unit according to claim 7 in which the elastic sheet is formed with a small opening in a manner corresponding to each depressing piece, the depressing piece having a depressed surface and a mounting surface which is located on the opposite side from the depressed surface and which is disposed in abutment against and secured to the elastic sheet, the small projection being integrally formed centrally in the mounting surface, the small projection extending through the small opening to project toward the reinforcing plate from the elastic sheet, each depressing piece and small projection being integrally formed from a hard resin.

10. A depression responsive switch unit according to claim 7, in which the elastic sheet, the depressing piece and the small projection are integrally formed by a thermoplastic elastomer or a silicone rubber.

11. A depression responsive switch unit according to claim 7, in which the elastic sheet and the small projection are integrally formed of a thermoplastic elastomer or silicone rubber while the depressing piece is formed of a hard resin and is secured to the elastic sheet as is the corresponding small projection.

12. A depression responsive switch unit in which a switch is turned on in response to a depression operation, comprising a case including a surface plate in which an opening is formed;

a reinforcing plate disposed opposite to a rear plate of the case and disposed within the case so as to be reciprocable with respect to the rear plate;

a second step switch interposed between the reinforcing plate and the rear plate and operated on by a movement of the reinforcing plate toward the rear plate;

a plurality of first step switches disposed on the reinforcing plate on the side located toward the surface plate;

a key operation base disposed on the case in a manner to block the opening in the surface plate and having depression openings formed therein in a manner corresponding to the location of each first step switch;

and a knob disposed on the key operation base on the opposite side from the reinforcing plate;

the knob including an elastic sheet which is formed of a thermoplastic elastomer or silicone rubber and having a marginal portion which is secured by being held sandwiched between the key operation base and the reinforcing plate, depressing pieces formed on the elastic sheet in a manner corresponding to each first step switch and each having a depressed surface on the front side of the elastic sheet and each disposed in the depression opening, and a small projection projecting from each depressing piece in the opposite direction from the depressed surface to be located close to or in contact with the first step switch.

13. A depression responsive switch unit according to claim 12 in which the elastic sheet is formed with openings to receive each depressing piece, each depressing piece having a flange which is disposed in abutment against and secured to the elastic sheet, each depressing piece, its flange and associated small projection being integrally formed from a hard resin.

14. A depression responsive switch unit according to claim 12 in which the elastic sheet, the depressing piece and the small projection are integrally formed by a thermoplastic elastomer or a silicone rubber.

15. A depression responsive switch unit according to claim 12 in which each depressing piece has an external portion which is exposed externally of the elastic sheet and a remainder, the external portion being formed from a hard resin while the remainder of the depression piece, the elastic sheet and the small projection being integrally formed of a thermoplastic elastomer or silicone rubber.

16. A depression responsive switch unit in which a switch is turned on in response to the depression of a knob, comprising a case including a surface plate in which an opening is formed, a rear plate opposing to said surface plate and a side wall between said surface plate and said rear plate;

a knob having a top plate portion disposed in the opening and a projection member disposed on the top plate portion to extend perpendicularly from the top plate portion toward the rear plate, said projection member having a projection end and an annular end surface portion surrounding said projection end;

a resilient member of a resilient material having an annular case connector portion secured to said side wall of the case, an annular knob connector portion secured to said annular end surface portion, and a body portion which integrally connects the knob connector portion to the case connector portion, wherein said resilient member is adapted to allow the knob to be readily displaceable in the direction of a depression which is perpendicular to the surface plate and to be hardly displaceable in a direction perpendicular to the direction of depression; and a switch disposed within the case on the rear plate in a position opposing to said projection end of the projection member and operatively turned on by displacement of the knob as said knob is depressed toward said rear plate.

17. A depression responsive switch unit according to claim 16 in which said body portion of the resilient member comprises at least three linear members which are integrally connected at their inner ends to the knob connector portion and at their outer ends to the case connector portion at an equi-angular interval so as to be configured symmetrically with respect to a center axis of the projection member.

18. A depression responsive switch unit according to claim 17 further comprising a second resilient member which is a ring of a resilient material formed in U-shape in section and connected at an inner end thereof to a marginal portion of the knob and at an outer end thereof to a perimeter around the opening.

19. A depression responsive switch unit according to claim 16 in which the resilient member is a ring which is U-shaped in section and connected at an inner end thereof to a marginal portion of the knob and at an outer end thereof to a perimeter around the opening.

20. A depression responsive switch unit according to claim 16 in which the resilient member comprises a first and a second resilient member which connect between the knob and the case at locations which are spaced apart in a direction perpendicular to the rear plate.

21. A depression responsive switch unit according to claim 16 further comprising a first step switch formed on the knob, wherein said first step switch can be turned on by a depressive force less than the depressive force required to turn on the switch.

22. A depression responsive switch unit according to claim 21 in which the knob comprises a reinforcing plate, a plurality of first step switches disposed on the reinforcing plate, a key operation base secured to the reinforcing plate and having openings each corresponding to each first step switch, a depressing piece which is at least partly disposed within each opening, an elastic sheet carrying the depressing pieces and formed of a thermoplastic elastomer or silicone rubber, and a small projection projecting from each depressing piece in a direction opposite from the depressed surface to be located close to or in contact with the first step switch.

23. A depression responsive switch unit according to claim 16 in which said body portion of the resilient member comprises an annular corrugated or plane plate which is integrally connected at an inner end thereof to said knob connector portion and at an outer end thereof to said case connector portion.

* * * * *